US008835086B2

(12) United States Patent
Watanabe et al.

(10) Patent No.: US 8,835,086 B2
(45) Date of Patent: Sep. 16, 2014

(54) ELECTROSTATIC IMAGE DEVELOPING TONER

(75) Inventors: Naohiro Watanabe, Shizuoka (JP); Naohito Shimota, Shizuoka (JP); Yasuaki Iwamoto, Shizuoka (JP); Masana Shiba, Shizuoka (JP); Satoshi Kojima, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/513,044

(22) PCT Filed: Dec. 1, 2010

(86) PCT No.: PCT/JP2010/071942

§ 371 (c)(1),
(2), (4) Date: May 31, 2012

(87) PCT Pub. No.: WO2011/068240

PCT Pub. Date: Jun. 9, 2011

(65) Prior Publication Data

US 2012/0264043 A1 Oct. 18, 2012

(30) Foreign Application Priority Data

Dec. 2, 2009 (JP) ..... 2009-274985

(51) Int. Cl.
*G03G 9/08* (2006.01)

(52) U.S. Cl.
USPC ..... 430/108.1; 430/108.8; 430/109.4

(58) Field of Classification Search
USPC ..... 430/108.1, 108.8, 109.4
See application file for complete search history.

(56) References Cited

U.S. PATENT DOCUMENTS

| | | | | |
|---|---|---|---|---|
| 2,297,691 | A | 10/1942 | Carlson | |
| 5,935,751 | A | 8/1999 | Matsuoka et al. | |
| 2004/0229143 | A1 | 11/2004 | Umemura et al. | |
| 2006/0040194 | A1 | 2/2006 | Sugiura et al. | |
| 2007/0218384 | A1 | 9/2007 | Matsumoto et al. | |
| 2008/0227001 | A1 | 9/2008 | Kadota et al. | |
| 2008/0311500 | A1 | 12/2008 | Yamada et al. | |
| 2009/0061345 | A1 | 3/2009 | Yamada et al. | |
| 2009/0214975 | A1* | 8/2009 | Awamura et al. | 430/113 |
| 2009/0220266 | A1* | 9/2009 | Shiraishi et al. | 399/58 |
| 2009/0220879 | A1* | 9/2009 | Matsumoto et al. | 430/108.1 |
| 2009/0220883 | A1* | 9/2009 | Sugiura | 430/109.4 |
| 2009/0245882 | A1* | 10/2009 | Ozeki et al. | 399/260 |
| 2009/0257792 | A1* | 10/2009 | Nakamura et al. | 399/307 |
| 2009/0269692 | A1* | 10/2009 | Awamura et al. | 430/137.1 |
| 2009/0291384 | A1* | 11/2009 | Takahashi | 430/110.4 |
| 2010/0075243 | A1 | 3/2010 | Shimota et al. | |

FOREIGN PATENT DOCUMENTS

| | | | |
|---|---|---|---|
| CN | 1403878 | A | 3/2003 |
| CN | 101520618 | A | 9/2009 |
| EP | 1 291 726 | A2 | 3/2003 |
| EP | 1 291 726 | A3 | 3/2003 |
| EP | 1 591 838 | | 11/2005 |
| EP | 1 998 226 | | 12/2008 |
| JP | 2663016 | | 10/1997 |
| JP | 10 20552 | | 1/1998 |
| JP | 11 7156 | | 1/1999 |
| JP | 11 329700 | | 11/1999 |
| JP | 2000-235279 | | 8/2000 |
| JP | 3225889 | | 11/2001 |
| JP | 2002 6541 | | 1/2002 |
| JP | 2002 268436 | | 9/2002 |
| JP | 3376019 | | 2/2003 |
| JP | 2003 167382 | | 6/2003 |
| JP | 2003 167383 | | 6/2003 |
| JP | 2004 226669 | | 8/2004 |
| JP | 2004 246345 | | 9/2004 |
| JP | 2004 258170 | | 9/2004 |
| JP | 2005 331925 | | 12/2005 |
| JP | 2006 106710 | | 4/2006 |
| JP | 2006 195040 | | 7/2006 |
| JP | 2006 258901 | | 9/2006 |
| JP | 2007 65620 | | 3/2007 |
| JP | 2007 79348 | | 3/2007 |
| JP | 2007 249082 | | 9/2007 |
| JP | 2008 76452 | | 4/2008 |
| JP | 2008 225130 | | 9/2008 |
| JP | 2008 233171 | | 10/2008 |
| JP | 2008 257227 | | 10/2008 |
| JP | 2008 276269 | | 11/2008 |
| JP | 2009 53357 | | 3/2009 |
| JP | 2009 58849 | | 3/2009 |
| JP | 2009 237166 | | 10/2009 |
| JP | 4449810 | | 4/2010 |

OTHER PUBLICATIONS

International Search Report Issued Feb. 8, 2011 in PCT/JP10/71942 Filed Dec. 1, 2010.
Combined Chinese Office Action and Search Report issued Jun. 13, 2013, in Patent Application No. 201080063004.4 (with English-language translation).
Extended European Search Report for application No. 10834687 issued Dec. 2, 2013 which was filed Dec. 1, 2010.

* cited by examiner

*Primary Examiner* — Hoa V Le
(74) *Attorney, Agent, or Firm* — Oblon, Spivak, McClelland, Maier & Neustadt, L.L.P.

(57) ABSTRACT

An electrostatic image developing toner including: a binder resin; a colorant; and a wax, wherein the intensity ratio of an absorbance at 2,850 $cm^{-1}$ derived from the wax to an absorbance at 828 $cm^{-1}$ derived from the binder resin, represented by "absorbance derived from the wax/absorbance derived from the binder resin", is in the range of 0.1 to 0.5, where the absorbances are measured by FTIR-ATR, and the intensity ratio serves as a value for determining the amount of the wax present within 0.3 μm in depth from surfaces of particles of the toner after the toner has been heated to 140° C. and then cooled, and wherein the toner has a storage elastic modulus of 5,000 Pa or greater at 140° C.

20 Claims, 3 Drawing Sheets

ELECTROSTATIC IMAGE DEVELOPING TONER

TECHNICAL FIELD

The present invention relates to an electrostatic image developing toner (hereinafter referred to also as "toner" for the sake of simplicity), a developer, a toner container and a process cartridge.

BACKGROUND ART

Image formation based upon an electrophotographic method is generally performed by a process which includes forming an electrostatic image on a photoconductor (electrostatic image bearing member), developing the electrostatic image with a developer so as to form a visible image (toner image), transferring the visible image onto a recording medium such as paper, and fixing the transferred visible image to the recording medium with application of heat, pressure, a solvent gas, etc. so as to obtain a fixed image (refer to PTL 1).

Regarding the developer, one-component developers for which magnetic toners or nonmagnetic toners are solely used, and two-component developers composed of toners and carriers are known. One-component developing methods are classified into magnetic one-component developing methods and nonmagnetic one-component developing methods, depending upon whether or not magnetic force is used to keep toner particles on a developing roller. As for the toners, each toner is generally produced by a kneading pulverization method in which a thermoplastic resin is melt-kneaded along with a colorant, etc., then finely pulverized and classified. Additionally, in some cases, inorganic fine particles or organic fine particles are added to surfaces of toner particles according to necessity, for the purpose of improving the fluidity and cleanability of the toner particles.

The toner obtained by the kneading pulverization method is generally fixed by being heated and melted with the use of a heat roll. In doing so, when the temperature of the heat roll is too high, hot offset may arise in which the toner melts excessively and fuses with the heat roll; conversely, when the temperature of the heat roll is too low, the toner does not sufficiently melt, and thus the fixation of the toner may be insufficient. In recent years, in view of energy saving and size reduction of apparatuses such as copiers, toners that achieve a favorable balance between hot offset resistance and low-temperature fixability, allowing the temperature at which hot offset arises to be higher and reducing the fixation temperature, have been demanded. Especially with regard to full-color copiers, full-color printers and the like, toners having lower melting points are demanded, since the glossiness and color mixture of images produced are important; however, the toners having low melting points easily cause hot offset and are inferior in terms of heat-resistant storage stability in a high-temperature and high-humidity environment. Accordingly, a conventional full-color apparatus employs a method of applying silicone oil or the like to a heat roll so as to provide toner releasability.

However, this method requires an oil tank, an oil applying device and the like, which leads to complexity and enlargement of an image forming apparatus. Moreover, since the thermal roll easily degrades, regular maintenance is required. Further, there is a problem in which the oil is attached to a recording medium such as copy paper or OHP film, thereby causing the color tone of images to degrade.

Accordingly, the method of providing toner releasability without application of oil to a heat roll, and adding a release agent such as a wax to a toner for preventing the problem of fusion of the toner is generally employed. Here, the toner releasability is greatly affected by the dispersed state of the wax in the toner. If the wax is compatible with a binder of the toner, toner releasability cannot be sufficiently exhibited. In the case where the wax is incompatible with the binder, the wax can exist as domain particles, thereby exhibiting toner releasability. On this occasion, if the dispersion diameter of the domain particles is too large, the proportion of the wax present in the vicinities of the surfaces of toner particles relatively increases; thus, the domain particles may aggregate, causing degradation of particle fluidity, the wax or a carrier may transfer to a photoconductor, etc. during long-term use, causing filming, and so it may be impossible to obtain images of favorable quality. If the dispersion diameter of the domain particles is too small, the wax is finely dispersed to excess and thus adequate toner releasability may not be yielded.

In the kneading pulverization method, since it is difficult to control the dispersion diameter of the domain particles and the wax is liable to be present on fracture surfaces, the amount of the wax exposed at the toner surface is large and so the above problems such as degradation of particle fluidity and occurrence of filming may arise. Further, there exist the following problems: the toner obtained by the kneading pulverization method generally has a wide particle size distribution, varies in frictional chargeability and easily causes fogging and the like; also, it is difficult to obtain a small-particle-diameter toner (2 μm to 8 μm in volume average particle diameter) for reasons related to production efficiency, and the demand for improvement in image quality can hardly be met.

Accordingly, note is taken of toners obtainable by granulation in an aqueous phase. The toners have narrow particle size distributions, can be easily reduced in particle diameter, make it possible to obtain high-quality, high-definition images, and are superior in offset resistance and low-temperature fixability due to high dispersion of a release agent such as a wax. Also, the toners are superior in transferability due to their uniform chargeability, and favorable in terms of fluidity, which gives an advantage in terms of design of a developing device (for example, it is possible to design a hopper with more freedom and reduce the toque with which a developing roll is rotated).

As the toners obtainable by granulation in an aqueous phase, toners obtainable by a suspension polymerization method or an emulsion polymerization aggregation method (hereinafter referred to also as "chemical toners") have been conventionally developed.

The suspension polymerization method is a method of obtaining toner particles by adding a monomer, a polymerization initiator, a colorant, a wax, etc. into an aqueous phase containing a dispersion stabilizer with agitation so as to form oil droplets, and then increasing the temperature to effect a polymerization reaction. The suspension polymerization method can achieve reduction in the diameter of the toner particles. Regarding the suspension polymerization method, it is difficult to make the wax appropriately present at the surfaces of the toner particles unless a dispersion stabilizer is used, because the wax tends to enter the oil droplets easily when the oil droplets are being formed; here, there is a problem in which if the dispersion stabilizer remains, it causes a decrease in chargeability.

As the emulsion polymerization aggregation method, there is, for example, a method proposed in which a polyester resin is used as a binder resin; fine particles obtained by subjecting the polyester resin to emulsion dispersion in an aqueous phase and then removing the solvent are aggregated with a dispersion formed by dispersing a colorant, a release agent (wax), etc. in an aqueous phase; and the aggregated matter is heated and fused so as to produce toner particles (refer to PTL 2 and PTL 3). According to this method, since ultrafine particles are not generated, there is no loss of emulsification, and further, it is possible to produce a toner having a sharp particle size distribution without needing classification. However, when the fine particles obtained after the solvent removal are aggregated, mere aggregation of the fine particles leads to insufficient unification thereof, thereby creating cracks or the like at interfaces after the unification. Therefore, a heating step for allowing the unification of the particles to proceed by heat is necessary.

However, when the heating is carried out, blooming of a wax component finely dispersed in the toner particles may arise (the wax component may be deposited on the surfaces), and/or aggregation, etc. of finely dispersed particles of the wax may arise, thereby making it impossible to maintain the state in which the wax is finely dispersed in a sufficient manner. Especially in the case where a wax having a low melting point is used, it easily melts in the heating step, and thus there is a problem in which favorable toner releasability cannot be secured and so there is a lack of suitability of the toner for oilless toner fixation with a heat roll.

Meanwhile, there has been proposed a method in which wax fine particles covered or impregnated with a vinyl polymer by adding a polymerizable vinyl monomer and a water-soluble polymerization initiator to a wax emulsion to effect polymerization are added to a toner composition when the toner composition is emulsified, and the wax fine particles are thereby uniformly and firmly attached to the toner surface (refer to PTL 4).

However, this method requires polymerization of a wax emulsion and a polymerizable vinyl monomer; moreover, the glass transition temperature (Tg) of a resin contained in the wax fine particles is high; thus, there is a problem in which the toner is inferior in low-temperature fixability and releasability at low temperatures.

Meanwhile, there has been proposed a method in which a polymerizable monomer that contains a polar group-containing substance and a wax is subjected to suspension polymerization in water to produce a toner, and thus the toner contains a wax having a low melting point that is unable to be used for a toner produced by a pulverization method (refer to PTL 5). In this method, a pseudo-capsule structure is employed in which a nonpolar component such as a wax is not present in the vicinities of the surfaces of toner particles, as opposed to a polar component, but covered with the polar component at the surfaces.

However, the dispersion of the wax inside the toner particles is not analyzed and is therefore unknown.

Meanwhile, use of a toner has been proposed in which the amount of a wax contained therein is in the range of 0.1% by mass to 40% by mass, and the wax exposed at the toner surface accounts for 1% by mass to 10% by mass of the constituent compounds exposed at the toner surface (refer to PTL 6). The proportion of the wax exposed at the toner surface is measured by ESCA and thus determined.

However, analysis based upon ESCA is only possible within approximately 0.1 μm in depth from the outermost surface of the toner, and thus it is difficult to know the dispersed state of the wax which lies further inside and suitably exhibits toner releasability in a fixing step.

Meanwhile, use of a toner has been proposed in which a wax is encapsulated in toner particles and is locally present at the surfaces of the toner particles (refer to PTL 7). However, details of the dispersed state of the wax in the vicinity of the toner surface are unknown.

Meanwhile, a method has been proposed in which the proportion of a wax exposed at the toner surface is measured by FTIR-ATR and thus determined (refer to JP-A No. PTL 8). However, there is a complete trade-off between blocking resistance of the toner and hot offset resistance of the toner, and between prevention of filming and prevention of wrapping of paper. Merely improving properties of the toner and controlling the dispersed state of the wax does not suffice to improve fixability of the toner further.

Therefore, there is a strong demand for a method for stably and efficiently obtaining a toner capable of maintaining the advantages of the chemical toners (i.e., a small particle diameter, a narrow particle size distribution and superior fluidity), yielding superior releasability at low temperatures, lessening the occurrence of filming, securing a favorable balance between low-temperature fixability and heat-resistant storage stability, and thus forming high-quality images. However, such a method has not yet beet provided in reality.

Generally, for fixation of toner, a method of directly pressing a fixing member (such as a fixing roller or a fixing belt) against an unfixed image so as to thermally melt the toner and fix the melted toner to an image bearing member (such as paper), in other words a thermal pressing fixing method, is preferably employed in view of thermal efficiency, simplicity of a fixing mechanism, production costs of the fixing member, etc.

FIG. 1 is an explanatory drawing of a belt-type fixing device (denoted by the letter Z in the drawing). As shown in FIG. 1, this fixing device includes a fixing belt B provided in a rotatable manner by means of a heating roller R3 and a fixing roller R1. The fixing belt B touches a cleaning roller R4 between the heating roller R3 and the fixing roller R1. The fixing roller R1 includes a core metal and a heat-resistant sponge rubber layer on the outer circumference of the core metal. The heating roller R3 includes a metal core which houses a heat source H such as a halogen lamp, and the fixing belt B is heated from inside with the radiant heat of the heat source H. The fixing device also includes a pressurizing roller R2 provided in such a manner as to touch the fixing roller R1 with the fixing belt B situated in between. By means of a pressurizing spring P, the pressurizing roller R2 pressurizes the fixing roller R1 and provides tension to the fixing belt B. Also, the pressurizing roller 2 is rotated by a driving unit (not shown), and this causes the fixing roller R1 to rotate depending upon the rotation of the pressurizing roller R2. In such a belt-type fixing device, transfer paper is passed along a guide G through the part between the fixing belt B heated by the heating roller R3 and the pressurizing roller R2, and toner attached onto the transfer paper is pressurized by the pressurizing roller R2 while softened by the heat of the fixing belt B, and thus fixed onto the transfer paper.

A belt-type fixing device utilizing electromagnetic induction heating includes a fixing roller, an opposed roller placed in parallel with the fixing roller and made of a nonmagnetic material, a fixing belt in the form of an endless belt placed in a winding manner between the fixing roller and the opposed roller, an induction coil which heats the fixing belt from outside, and a pressurizing roller which presses the fixing roller with the fixing belt situated in between. Recording paper is passed between the fixing belt and the pressurizing roller; at this time, unfixed toner on the recording paper is fixed thereto by the heat from the fixing belt and the pressing force of the pressurizing roller (refer to PTL 9). As shown in cross section in FIG. 2, a fixing belt (denoted by the letter C in the drawing) generally has a laminated structure in which a base material 1, a heat generating layer 2, an elastic layer 3 and a release layer 4 are laid in this order from the bottom to the top.

The base material 1 is in the form of an endless belt made of a heat-resistant resin. Examples of the material for this heat-resistant resin include polyimides, polyamideimides and polyether ketones (PEEK). The thickness of the base material 1 is generally set at 20 μm to 100 μm in view of the rigidity and heat capacity of the fixing belt.

For the heat generating layer 2, a metal such as SUS, iron, nickel, manganese, titanium, chromium or copper is used. The elastic layer 3 is necessary to yield uniformity of images, and a heat-resistant rubber (approximately 100 μm to approximately 300 μm in thickness) such as silicone rubber or fluorine rubber is used therefor. The release layer 4 is formed of a fluorine rein, etc. superior in heat resistance and durability, in view of its contact under pressure with transfer paper and toner.

However, in the above-mentioned conventional fixing device, the fixing belt is merely heated by the induction coil and the temperature of the fixing belt is not controlled. Thus, hot offset easily arises at both ends of the belt. Specifically, when recording paper of small size is continuously fed, both ends of the belt are not deprived of heat by the recording paper and thus increase in temperature; in this state, when recording paper of large size is fed, there is a problem in which hot offset arises at both ends of the belt.

Also, in the conventional fixing device, ends of the opposed roller have large heat capacity owing to the presence of bearings, etc. at the ends. Thus, when the fixing belt has started being heated by the induction coil, the heat travels toward the ends of the opposed roller, and the temperature increase rate of the ends of the opposed roller is lower than that of the center of the opposed roller as shown in FIG. 3. Consequently, there is a problem in which the time spent until the fixing device becomes usable, namely the rising time, lengthens.

Meanwhile, there has been proposed a fixing device including a fixing belt which endlessly moves while supported by a heating roller and a fixing roller with a small belt curvature and heated by the heating roller, wherein the fixing belt is pressed against a toner image on a transfer material so as to heat and fix the toner image on the transfer material (refer to PTL 10). This fixing belt generally has a three-layer structure composed of a substrate made of a heat-resistant resin (such as a polyimide) or metal, an elastic layer made of a heat-resistant rubber or elastomer, and a release layer (outermost layer) made of a fluorine resin. The release layer made of a fluorine resin is formed by covering the elastic layer with a fluorine resin tube (formed by extrusion molding) and then heating and melting (hereinafter referred to also as "firing") the fluorine resin. Alternatively, the release layer is formed by applying fluorine resin particles over the elastic layer by means of a spray, etc. and then firing the fluorine resin. As just described, by forming the release layer of a fluorine resin, the fixing belt can be superior in toner releasability and heat resistance. The fixing belt yields great effects, especially in terms of toner releasability, and is therefore effective against hot offset of toner and wrapping of paper.

However, the fluorine resin is poor in bendability, so that when the fixing belt is used for a long period of time, supported by the heating roller and the fixing roller with a small belt curvature, there is a problem in which cracks are created in the release layer and thus sufficient durability of the belt cannot be secured.

Examinations of fixing mechanisms have been carried out (refer to NPL 1). Such examinations and proposals of fixing mechanisms alone do not lead to a fundamental solution to the problems for reasons similar to the above reasons.

Nowadays, application of electrophotographic image forming methods to fields of printing with high image areas and at high speed, such as offset printing, is becoming common. Here, fixation of an image to an image transfer medium with the lowest possible energy is an objective of the electrophotographic image forming methods. Meanwhile, regarding toners for use in image formation, it is important that the fixation temperature of the toners themselves be reduced and that hot offset at high temperatures be prevented. Accordingly, there has been a proposal to reduce the fixation temperature by using a polyester resin that is advantageous in terms of low-temperature fixation. Also, as methods for preventing hot offset, the following methods are well known: a method of controlling the viscoelasticity of a toner by introducing a resinous polymer into the toner; and a method of suppressing the viscoelasticity of a toner by enhancing the releasability of the toner from a fixing member with the use of a release agent such as a wax.

Regarding the use of a wax, use of a paraffin wax has been proposed (refer to PTL 11); further, definition of the range of melting points of a wax in accordance with the DSC method has been proposed. In many such proposals, effects on toner releasability have been confirmed. Here, as described above, high image quality which does not differ from the initial image quality (even when printing is carried out in large amounts with a high image area) is required in the field of high-speed printing.

In the case where a conventionally proposed wax is used in an electrophotographic image forming apparatus which conducts printing in large amounts, it has been proved that a paraffin wax, which is highly volatile, causes troubles such as smearing of members of the image forming apparatus and smearing of transfer media themselves.

For example, it has been proposed that by determining the heating loss at 220° C., favorable effects can be exhibited in securing storage stability and preventing a spent carrier and filming over a photoconductor (refer to PTL 12). However, even when the requirements of the heating loss at this temperature are not satisfied, the above-mentioned troubles may not arise in the case of a toner producing method using a type of wax and an aqueous medium. If anything, it has been proved that even when the requirements of the heating loss are satisfied, the prevention of smearing of members may be insufficient in high-speed printing, and the separability of transfer media may also be insufficient at the time of high-speed printing. Also, it has been proved that when the requirements of the heating loss are not satisfied, favorable effects on prevention of smearing of the members can be yielded by satisfying the claims of the present application. Meanwhile, in the case where a paraffin wax having a high melting point is merely used, it is difficult to secure desired toner releasability, thereby possibly causing hot offset and/or decreasing image quality (e.g., decreasing glossiness). In reality, merely determining the melting point of the paraffin wax does not suffice to prevent smearing inside a machine or secure desired toner fixability.

Also, images produced by high-speed printing are, in most cases, full-color images with high image area ratios. In cases where a heating medium and a transfer medium need to be separated from each other at high speed and surely in a fixing step, it is very important to achieve a favorable balance between securement of toner releasability with the use of a wax and prevention of smearing inside a machine.

Meanwhile, there has been a proposal to remove nonuniformity of images caused at the time of fixation and thereby increase image quality, by using a microcrystalline wax (refer to PTL 13). To remove nonuniformity of images, the endothermic peak of the wax and the half width of the endothermic peak are defined. Although this makes it possible to remove nonuniformity of images, the wax has a high melting point, which is disadvantageous to low-temperature fixation. Meanwhile, merely lowering the endothermic peak of the wax in view of low-temperature fixability leaves a problem concerning separability between paper and roller(s) at high temperatures.

As just described, in reality, further improvement is required to secure a favorable balance between low-temperature fixability and heat-resistant storage stability and a favorable balance between low-temperature fixability and separability of paper from roller(s) at high temperatures, reduce the volatile matter content at the time of fixation and thus obtain high-quality images.

CITATION LIST

Patent Literature

PTL 1 U.S. Pat. No. 2,297,691
PTL 2 Japanese Patent Application Laid-Open (JP-A) No. 10-020552
PTL 3 JP-A No. 11-007156
PTL 4 JP-A No. 2004-226669
PTL 5 Japanese Patent (JP-B) No. 2663016
PTL 6 JP-B No. 3225889
PTL 7 JP-A No. 2002-6541
PTL 8 JP-A No. 2004-246345
PTL 9 JP-A No. 11-329700
PTL 10 JP-A No. 2002-268436
PTL 11 JP-B No. 3376019
PTL 12 JP-A No. 2005-331925
PTL 13 JP-A No. 2006-195040

Non Patent Literature

NPL 1 "Examination of On-demand Fixation Technology" (A-11) presented at Japan Hardcopy '94 (1994.6.23-24, hosted by Society of Electrophotography of Japan)

SUMMARY OF INVENTION

Technical Problem

The present invention is aimed at solving the problems in related art and achieving the following object. An object of the present invention is to provide a toner with a small particle diameter and a narrow particle size distribution, which is superior in releasability at low temperatures, lessens the occurrence of filming, enhances blocking resistance, reduces the volatile matter content at the time of fixation, secures a favorable balance between low-temperature fixability and heat-resistant storage stability and a favorable balance between low-temperature fixability and separability of paper from roller(s) at high temperatures, and thus makes it possible to obtain high-quality images; an image forming method; and an image forming apparatus.

Solution to Problem

As a result of carrying out earnest examinations to achieve the above object, the present inventors have found that a toner which is superior in releasability at low temperatures, lessens the occurrence of filming, enhances blocking resistance, reduces the volatile matter content at the time of fixation, secures a favorable balance between low-temperature fixability and heat-resistant storage stability and a favorable balance between low-temperature fixability and separability of paper from roller(s) at high temperatures, and thus makes it possible to obtain high-quality images can be realized by providing an electrostatic image developing toner which includes a binder resin, a colorant and a wax, wherein the intensity ratio of an absorbance at 2,850 $cm^{-1}$ derived from the wax to an absorbance at 828 $cm^{-1}$ derived from the binder resin, represented by "absorbance derived from the wax/absorbance derived from the binder resin", is in the range of 0.1 to 0.5, where the absorbances are measured by FTIR-ATR (fourier transform infrared attenuated total reflectance spectroscopy), and the intensity ratio serves as a value for determining the amount of the wax present within 0.3 μm in depth from surfaces of particles of the toner after the toner has been heated to 140° C. and then cooled, and wherein the toner has a storage elastic modulus of 5,000 Pa or greater at 140° C. This has led to completion of the present invention.

The present invention is based upon the findings of the present inventors, and means for solving the problems are as follows.

<1> An electrostatic image developing toner including: a binder resin; a colorant; and a wax, wherein the intensity ratio of an absorbance at 2,850 $cm^{-1}$ derived from the wax to an absorbance at 828 $cm^{-1}$ derived from the binder resin, represented by "absorbance derived from the wax/absorbance derived from the binder resin", is in the range of 0.1 to 0.5, where the absorbances are measured by FTIR-ATR (fourier transform infrared attenuated total reflectance spectroscopy), and the intensity ratio serves as a value for determining the amount of the wax present within 0.3 μm in depth from surfaces of particles of the toner after the toner has been heated to 140° C. and then cooled, and wherein the toner has a storage elastic modulus of 5,000 Pa or greater at 140° C.

<2> The electrostatic image developing toner according to <1>, wherein the wax has a melting point of 65° C. to 95° C. and decreases in mass by 10% or less at 165° C.

<3> The electrostatic image developing toner according to <1> or <2>, wherein the wax is at least one selected from the group consisting of a microcrystalline wax, a paraffin wax, a polyethylene wax and a polypropylene wax.

<4> The electrostatic image developing toner according to any one of <1> to <3>, wherein the binder resin contains a reaction product obtained by reacting together an active hydrogen group-containing compound and a polymer reactive with the active hydrogen group.

<5> The electrostatic image developing toner according to any one of <1> to <4>, wherein components of the binder resin include one of a binder resin and a binder resin precursor, or both a binder resin and a binder resin precursor.

<6> The electrostatic image developing toner according to <5>, wherein the binder resin precursor is a combination of the active hydrogen group-containing compound and the polymer reactive with the active hydrogen group, and wherein the binder resin precursor is included as the reaction product obtained by reacting together the active hydrogen group-containing compound and the polymer reactive with the active hydrogen group, in emulsifying or dispersing the compound and the polymer in an aqueous medium.

<7> The electrostatic image developing toner according to <6>, wherein the polymer reactive with the active hydrogen group has a weight average molecular weight of 3,000 to 45,000.

<8> The electrostatic image developing toner according to any one of <1> to <7>, further including a wax dispersant in an amount of 10 parts by mass to 300 parts by mass per 100 parts by mass of the wax.

<9> The electrostatic image developing toner according to any one of <1> to <8>, wherein the binder resin contains a polyester resin.

<10> The electrostatic image developing toner according to any one of <1> to <9>, wherein the amount of the binder resin included is in the range of 50% by mass to 100% by mass.

<11> The electrostatic image developing toner according to any one of <1> to <10>, wherein the binder resin has a weight average molecular weight of 3,000 to 30,000.

<12> The electrostatic image developing toner according to any one of <1> to <11>, wherein the binder resin has an acid value of 12 mgKOH/g to 30 mgKOH/g.

<13> The electrostatic image developing toner according to any one of <1> to <12>, wherein the binder resin has a glass transition temperature of 35° C. to 65° C.

<14> The electrostatic image developing toner according to any one of <1> to <13>, wherein the ratio of the volume average particle diameter of the toner particles to the number average particle diameter of the toner particles, represented by "volume average particle diameter/number average particle diameter" is in the range of 1.00 to 1.25.

<15> The electrostatic image developing toner according to any one of <1> to <14>, wherein the toner particles have a volume average particle diameter of 1 μm to 7 μm.

<16> The electrostatic image developing toner according to any one of <1> to <15>, having a glass transition temperature of 40° C. to 70° C.

<17> The electrostatic image developing toner according to any one of <1> to <16>, wherein the intensity ratio of an absorbance at 2,850 $cm^{-1}$ derived from the wax to an absorbance at 828 $cm^{-1}$ derived from the binder resin, represented by "absorbance derived from the wax/absorbance derived from the binder resin", is in the range of 0.01 to 0.150, where the absorbances are measured by FTIR-ATR (fourier transform infrared attenuated total reflectance spectroscopy), and the intensity ratio serves as a value for determining the amount of the wax present within 0.3 μm in depth from the surfaces of the particles of the toner at 23° C.

<18> The electrostatic image developing toner according to any one of <1> to <17>, wherein the toner is obtained by dissolving or dispersing the binder resin, the colorant and the wax in an organic solvent, dispersing the solution or the dispersion liquid in an aqueous solvent, and subsequently removing the organic solvent.

<19> The electrostatic image developing toner according to <18>, wherein, in the removal of the organic solvent, heating is performed for 60 minutes or longer at 30° C. to 65° C. when the amount of residual organic solvent is in the range of 2% by mass to 15% by mass.

<20> A developer including: the electrostatic image developing toner according to any one of <1> to <19>; and a carrier.

<21> A toner container including: the electrostatic image developing toner according to any one of <1> to <19>.

<22> A process cartridge detachably mountable to a main body of an image forming apparatus, including: at least one selected from the group consisting of a latent electrostatic image bearing member, a developing unit configured to develop a latent electrostatic image formed on the latent electrostatic image bearing member, using a toner, a charging unit, and a cleaning unit, wherein the toner is the electrostatic image developing toner according to any one of <1> to <19>.

Advantageous Effects of Invention

The present invention makes it possible to provide a toner with a small particle diameter and a narrow particle size distribution, which is superior in releasability at low temperatures, lessens the occurrence of filming, enhances blocking resistance, yields superior long-term storage stability, reduces the volatile matter content at the time of fixation, secures a favorable balance between low-temperature fixability and heat-resistant storage stability and a favorable balance between low-temperature fixability and separability of paper from roller(s) at high temperatures, and thus makes it possible to obtain high-quality images; an image forming method; and an image forming apparatus.

Figure 1:
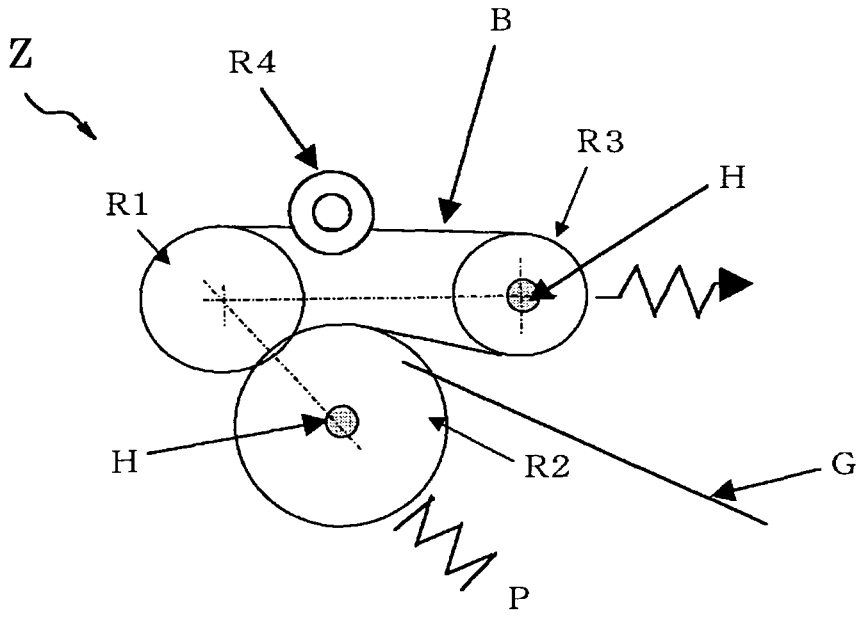
FIG. 1 is a schematic explanatory drawing of a belt-type fixing device.
Figure 2:
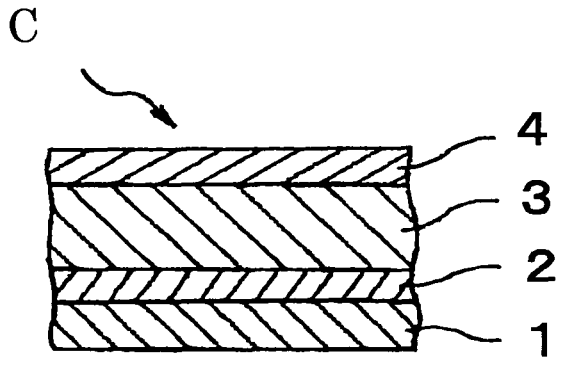
FIG. 2 is a cross-sectional view of a fixing belt.
Figure 3:
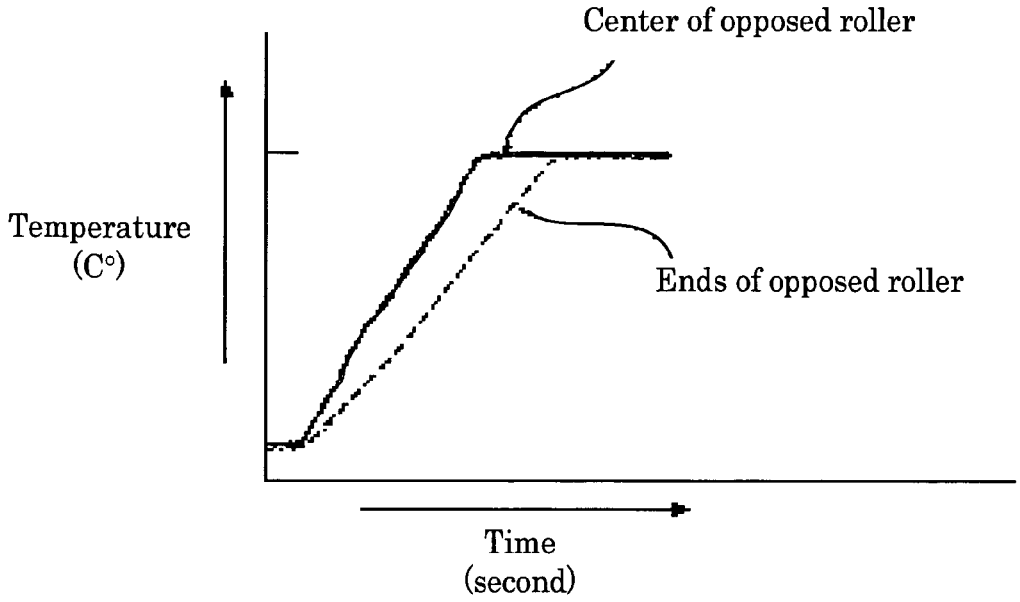
FIG. 3 is a graph showing an increase in the temperature of an opposed roller.

DESCRIPTION OF EMBODIMENTS (Electrostatic Image Developing Toner)

An electrostatic image developing toner of the present invention includes a binder resin, a colorant and a wax, and may further include a charge controlling agent, resin particles, inorganic particles, a fluidity improver, a cleanability improver, a magnetic material, a metal soap, a wax dispersant, etc.

Also, regarding the electrostatic image developing toner, the intensity ratio of an absorbance at 2,850 $cm^{-1}$ derived from the wax to an absorbance at 828 $cm^{-1}$ derived from the binder resin, represented by "absorbance derived from the wax/absorbance derived from the binder resin", is in the range of 0.1 to 0.5, where the absorbances are measured by FTIR-ATR (fourier transform infrared attenuated total reflectance spectroscopy), and the intensity ratio serves as a value for determining the amount of the wax present within 0.3 μm in depth from surfaces of particles of the toner after the toner has been heated to 140° C. and then cooled; further, the toner has a storage elastic modulus of 5,000 Pa or greater at 140° C.

Conventionally, the toner in which a wax component is encapsulated has been used for the purpose of securing separability between the toner surface and a fixing roller or belt. It is, however, known that the wax component is often attached to other members such as a photoconductor during long-term printing, etc., thereby causing a decrease in image quality, etc. Accordingly, it is important to suppress the attachment of the wax component to the other members, secure fixability and releasability of the toner, and achieve separability between the toner surface and the fixing roller or belt at high temperatures.

The attachment of the wax component can be suppressed by reducing the amount thereof in the toner. However, when the amount of the wax component is reduced, it is difficult to secure fixability and releasability of the toner and separability between the toner surface and the fixing roller or belt. Similar problems also arise when the wax domain diameter is reduced.

Hence, the following points are important: the amount and domain diameter of the wax component suffice to secure fixability and releasability of the toner, the wax component is encapsulated in the toner so that the other members such as a photoconductor are not smeared, attachment of the wax component to the other members is suppressed as the wax component is exposed at the toner surface at the time of fixation, and fixability and releasability of the toner and separability between the toner surface and the fixing roller or belt are secured.

<Storage Elastic Modulus>

The storage elastic modulus of the toner at 140° C. is 5,000 Pa or greater, preferably 6,000 Pa or greater. The upper limit of the storage elastic modulus is not particularly limited and may be suitably selected according to the intended purpose, but is preferably 10,000 Pa or less. When the storage elastic modulus is less than 5,000 Pa, the separability between the toner surface and the fixing roller or belt may degrade at high temperatures. When the storage elastic modulus is greater than 10,000 Pa, the low-temperature fixability of the toner may degrade.

The storage elastic modulus of the toner, and the intensity ratio of the absorbance at 2,850 $cm^{-1}$ derived from the wax to the absorbance at 828 $cm^{-1}$ derived from the binder resin, with the absorbances being measured by FTIR-ATR (fourier transform infrared attenuated total reflectance spectroscopy), can be appropriately adjusted by changing the length of time and the temperature at the time of desolvation. Notably in the case of a toner including a binder resin which contains a reaction product obtained by reacting together an active hydrogen group-containing compound and a polymer reactive with the active hydrogen group, the storage elastic modulus of the toner can be controlled by changing the length of time and the temperature at the time of desolvation. The state of the wax present inside the toner can be controlled by bringing about a temperature change while a certain amount of solvent remains during desolvation, and the wax can be transferred to the vicinity of the toner surface by increasing the temperature or lengthening the time, which makes it easier for the wax to seep out at the time of fixation. That is, the wax seeps out in larger amounts at 140° C. Also in the case of a toner including a binder resin which contains a reaction product obtained by reacting together an active hydrogen group-containing compound and a polymer reactive with the active hydrogen group, the reaction can proceed more easily, and the storage elastic modulus is higher. Although it is unclear why the storage elastic modulus is higher, it is inferred that, by carrying out heating with a certain amount of solvent remaining, transfer of substances inside the toner easily takes place and the reaction involving the active hydrogen group easily proceeds. When heating is carried out with a large amount of solvent remaining, toner particles may combine together or the wax may be exposed at the surfaces of the toner particles; further, the reaction between the polymer and the active hydrogen group may proceed excessively, which makes it easier for the storage elastic modulus to be high. When the amount of solvent remaining is small, the toner particles hardly combine together, but transfer of the wax inside the toner particles hardly takes place, and further, the storage elastic modulus is liable to be low.

The storage elastic modulus is measured as follows. The toner is formed into a pellet with a diameter of 20 mm and a thickness of 2.00 mm (pressurization: 40 kN) and fixed to a parallel plate with a diameter of 20 mm, using a dynamic viscoelasticity measuring apparatus (RHEOSTRESS RS50, manufactured by Haake GmbH). Then the storage elastic modulus is measured.

The measurement is carried out under the following conditions: sweep of frequency; 0.1 Hz to 5 Hz in frequency; 140° C. in temperature; 0.1 in distortion. The storage elastic modulus is obtained based upon a frequency of 1.47 Hz.

<Binder Resin>

The binder resin exhibits adhesion to a recording medium such as paper, and it is preferred that components of the binder resin include a binder resin and a binder resin precursor. Inclusion of these makes it easier to add a gel component into the toner. Further, a binder resin suitably selected from known binder resins may be included in the toner.

The amount of the binder resin included in the toner is not particularly limited and may be suitably selected according to the intended purpose but is preferably in the range of 50% by mass to 95% by mass, more preferably 80% by mass to 95% by mass. When the amount is less than 50% by mass, the hot offset resistance and cold offset resistance of the toner may degrade. When the amount is more than 95% by mass, the fixation lower limit temperature may become high and the coloring power of the toner may decrease.

The weight average molecular weight of the binder resin is preferably 3,000 or greater, more preferably in the range of 3,000 to 30,000, even more preferably 4,000 to 30,000, particularly preferably 4,000 to 20,000. When the weight average molecular weight is less than 3,000, the hot offset resistance of the toner may decrease. When the weight average molecular weight is greater than 30,000, the fixation lower limit temperature may become high.

The weight average molecular weight can, for example, be determined by measuring the molecular weight distribution of components of the binder resin soluble in tetrahydrofuran, utilizing gel permeation chromatography (GPC).

Here, the measurement utilizing GPC can, for example, be carried out as follows. First of all, a column is stabilized in a heat chamber set at 40° C. At this temperature, tetrahydrofuran as a column solvent is applied at a flow rate of 1 mL/min, and 50 μL to 200 μL of a tetrahydrofuran solution with the concentration of a sample being adjusted to 0.05% by mass to 0.6% by mass is poured to carry out the measurement. The molecular weight is calculated based upon the relationship between count numbers and logarithmic values of a calibration curve produced using several types of standard samples. As the standard samples for producing the calibration curve, monodisperse polystyrenes having molecular weights of $6\times10^2$, $2.1\times10^2$, $4\times10^2$, $1.75\times10^4$, $1.1\times10^5$, $3.9\times10^5$, $8.6\times10^5$, $2\times10^6$ and $4.48\times10^6$ respectively (manufactured by Pressure Chemical Company or Toyo Soda Manufacturing Co., Ltd.) may be used. On this occasion, it is preferable to use standard samples of 10 types or so. Parenthetically, a refractive index detector may be employed as a detector.

The acid value of the binder resin is preferably in the range of 12 mgKOH/g to 30 mgKOH/g, more preferably 12 mgKOH/g to 25 mgKOH/g. In general, when the toner has an acid value, the toner can be negatively charged with ease. The acid value can, for example, be measured in accordance with the method defined in JIS K0070.

The hydroxyl value of the binder resin is preferably 25 mgKOH/g or greater, more preferably in the range of 30 mgKOH/g to 60 mgKOH/g, more preferably 35 mgKOH/g to 58 mgKOH/g. When the hydroxyl value is less than 35 mgKOH/g, it may be difficult to achieve a favorable balance between the heat-resistant storage stability and the low-temperature fixability of the toner.

The hydroxyl value can, for example, be measured in accordance with the method defined in JIS K0070.

The glass transition temperature of the binder resin is preferably in the range of 35° C. to 65° C., more preferably 45° C. to 65° C. When the glass transition temperature is lower than 35° C., the heat-resistant storage stability of the toner may degrade. When the glass transition temperature is higher than 65° C., the low-temperature fixability of the toner may be insufficient. Note that a toner including as a binder resin a polyester resin obtained through a cross-linking reaction or an elongation reaction has favorable storage stability even if the glass transition temperature thereof is low.

The glass transition temperature can, for example, be measured by means of a thermal analysis apparatus and a differential scanning calorimeter. As the thermal analysis apparatus, TA-60WS (manufactured by SHIMADZU CORPORATION) can, for example, be used. As the differential scanning calorimeter, DSC-60 (manufactured by SHIMADZU CORPORATION) can, for example, be used.

The binder resin may be suitably selected according to the intended purpose. For example, a polyester resin or the like may be used. To improve low-temperature fixability and glossiness, use of a polyester resin which is not modified (an unmodified polyester resin) is preferable.

The acid value of the unmodified polyester resin is preferably in the range of 12 mgKOH/g to 30 mgKOH/g, more preferably 15 mgKOH/g to 25 mgKOH/g. In general, when the toner has an acid value, the toner can be negatively charged with ease.

The hydroxyl value of the unmodified polyester resin is preferably 5 mgKOH/g or greater, more preferably in the range of 10 mgKOH/g to 120 mgKOH/g, even more preferably 20 mgKOH/g to 80 mgKOH/g. When the hydroxyl value is less than 5 mgKOH/g, it may be difficult to achieve a favorable balance between heat-resistant storage stability and low-temperature fixability.

The glass transition temperature of the unmodified polyester resin is preferably in the range of 30° C. to 70° C., more preferably 35° C. to 60° C., even more preferably 35° C. to 55° C. When the glass transition temperature is lower than 30° C., the heat-resistant storage stability of the toner may decrease. When the glass transition temperature is higher than 70° C., the low-temperature fixability of the toner may decrease.

Examples of the unmodified polyester resin include polycondensation products of polyols and polycarboxylic acids. In terms of low-temperature fixability and hot offset resistance, it is desirable for part of the unmodified polyester resin to be compatible with a urea-modified polyester resin, namely to have a structure compatible with and similar to the structure of the urea-modified polyester resin.

The mass average molecular weight of the unmodified polyester resin is preferably in the range of 1,000 to 30,000, more preferably 1,500 to 15,000. When the mass average molecular weight is less than 1,000, there may be a decrease in heat-resistant storage stability. Accordingly, the amount of components which are less than 1,000 in mass average molecular weight is preferably in the range of 8% by mass to 28% by mass. When the mass average molecular weight of the unmodified polyester resin is greater than 30,000, there may be a decrease in low-temperature fixability.

In the case where the toner includes the unmodified polyester resin, the mass ratio of the after-mentioned isocyanate group-containing polyester prepolymer to the unmodified polyester resin is preferably in the range of 5/95 to 25/75, more preferably 10/90 to 25/75. When the mass ratio is less than 5/95, there may be a decrease in hot offset resistance. When the mass ratio is greater than 25/75, there may be a decrease in low-temperature fixability and image glossiness.

In the case of the after-mentioned toner including an active hydrogen group-containing compound and a polymer reactive with the active hydrogen group, wherein a reaction product, obtained by reacting together the compound and the polymer in emulsifying or dispersing the compound and the polymer in an aqueous medium, is included as a binder resin, the following have been found (although the reasons therefor cannot be unequivocally stated): when the acid value of the unmodified polyester resin is lower than 12 mgKOH/g, the reaction rate increases, the viscosity of the toner material liquid increases and it is difficult to emulsify or disperse the compound and the polymer in the aqueous medium; when the acid value thereof is higher than 30 mgKOH/g, there is degradation of hot offset resistance.

<<Binder Resin Precursor>>

The binder resin precursor is not particularly limited and may be suitably selected according to the intended purpose but is preferably a polymer (hereinafter referred to also as "prepolymer") reactive with an active hydrogen group.

The prepolymer may be suitably selected from known resins, etc. Examples thereof include polyol resins, polyacrylic resins, polyester resins, epoxy resins, and derivatives of these resins. Use of a modified polyester resin among these is preferable in terms of transparency and fluidity at the time when melted. The above resins may be used individually or in combination.

The modified polyester resin capable of reacting with the active hydrogen group-containing compound is preferably an isocyanate group-containing polyester as a polymer reactive with the active hydrogen group. Additionally, when the isocyanate group-containing polyester is reacted with the active hydrogen group-containing compound, a urethane bond may be formed by addition of an alcohol. The molar ratio of the thusly produced urethane bond to a urea bond (this molar ratio is utilized to distinguish between the foregoing urethane bond and a urethane bond contained in an isocyanate group-containing polyester prepolymer) is preferably in the range of 0 to 9, more preferably ¼ to 4, particularly preferably ⅔ to 7/3. When this ratio is greater than 9, there may be a decrease in hot offset resistance.

Examples of the prepolymer's functional group(s) capable of reacting with the active hydrogen group include an isocyanate group, an epoxy group, a carboxyl group, and the functional group represented by "—COC—". Preferable among these is an isocyanate group. The prepolymer may have one such functional group or may have two or more such functional groups.

As the prepolymer, use of a polyester resin which contains an isocyanate group, etc. capable of forming a urea bond is preferable because it is possible to easily adjust the molecular weight(s) of polymeric component(s) and because it is possible to secure oilless low-temperature fixation properties of a dry toner, notably to secure favorable releasability and fixability of the dry toner even without a mechanism of applying release oil to a heating medium used for fixation.

The isocyanate group-containing polyester prepolymer may be suitably selected according to the intended purpose. Examples thereof include a reaction product of a polyisocyanate and an active hydrogen group-containing polyester resin obtained by subjecting a polyol and a polycarboxylic acid to polycondensation.

The polyol is not particularly limited and may be suitably selected according to the intended purpose. Examples thereof include diols, trihydric or higher alcohols, and mixtures of diols and trihydric or higher alcohols. Preference is given to diols, and mixtures which are each composed of a diol and a small amount of a trihydric or higher alcohol. These may be used individually or in combination.

Examples of the diols include alkylene glycols such as ethylene glycol, 1,2-propylene glycol, 1,3-propylene glycol, 1,4-butanediol and 1,6-hexanediol; oxyalkylene group-containing diols such as diethylene glycol, triethylene glycol, dipropylene glycol, polyethylene glycol, polypropylene glycol and polytetramethylene glycol; alicyclic diols such as 1,4-cyclohexanedimethanol and hydrogenated bisphenol A; alkylene oxide (ethylene oxide, propylene oxide, butylene oxide, etc.) adducts of alicyclic diols; bisphenols such as bisphenol A, bisphenol F and bisphenol S; and alkylene oxide (ethylene oxide, propylene oxide, butylene oxide, etc.) adducts of bisphenols. The alkylene glycols preferably have 2 to 12 carbon atoms each. Among the above examples, C2-C12 alkylene glycols and alkylene oxide adducts of bisphenols are preferable, particularly alkylene oxide adducts of bisphenols, and combinations of alkylene oxide adducts of bisphenols and C2-C12 alkylene glycols.

Examples of the trihydric or higher alcohols include trihydric or higher aliphatic alcohols, trihydric or higher polyphenols, and alkylene oxide adducts of trihydric or higher polyphenols. Specific examples thereof include glycerin, trimethylolethane, trimethylolpropane, pentaerythritol and sorbitol. Specific examples of the trihydric or higher polyphenols include trisphenol A, phenol novolac and cresol novolac. Specific examples of the alkylene oxide adducts of trihydric or higher polyphenols include trihydric or higher polyphenols to which allylene oxides such as ethylene oxide, propylene oxide and butylene oxide are added.

In the case where a diol and a trihydric or higher alcohol are mixed together, the mass ratio of the trihydric or higher alcohol to the diol is preferably in the range of 0.01% by mass to 10% by mass, more preferably 0.01% by mass to 1% by mass.

The polycarboxylic acid is not particularly limited and may be suitably selected according to the intended purpose. As the polycarboxylic acid, it is possible to use, for example, a dicarboxylic acid, a trivalent or higher carboxylic acid, or a mixture of a dicarboxylic acid and a trivalent or higher carboxylic acid. Preference is given to a dicarboxylic acid, and a mixture of a dicarboxylic acid and a small amount of a trivalent or higher carboxylic acid. These may be used individually or in combination.

Examples of the dicarboxylic acid include divalent alkanoic acids, divalent alkene acids and aromatic dicarboxylic acids. Examples of the divalent alkanoic acids include succinic acid, adipic acid and sebacic acid. The divalent alkene acids preferably have 4 to 20 carbon atoms each; examples thereof include maleic acid and fumaric acid. The aromatic dicarboxylic acids preferably have 8 to 20 carbon atoms each; examples thereof include phthalic acid, isophthalic acid, terephthalic acid and naphthalene dicarboxylic acid. Preferable among these are C4-C20 divalent alkene acids and C8-C20 aromatic dicarboxylic acids.

As the trivalent or higher carboxylic acid, a trivalent or higher aromatic carboxylic acid, etc. may be used. The trivalent or higher aromatic carboxylic acid preferably has 9 to 20 carbon atoms; specific examples thereof include trimellitic acid and pyromellitic acid.

As the polycarboxylic acid, it is also possible to use an acid anhydride or lower alkyl ester of any one of a dicarboxylic acid, a trivalent or higher carboxylic acid, and a mixture of a dicarboxylic acid and a trivalent or higher carboxylic acid. Specific examples of the lower alkyl ester include methyl esters, ethyl esters and isopropyl esters.

In the case where a dicarboxylic acid and a trivalent or higher carboxylic acid are mixed together, the mass ratio of the trivalent or higher carboxylic acid to the dicarboxylic acid is preferably 10% by mass or less, more preferably in the range of 0.01% by mass to 1% by mass.

As for the mixture ratio between the polyol and the polycarboxylic acid at the time of polycondensation, the equivalence ratio of the hydroxyl group of the polyol to the carboxyl group of the polycarboxylic acid is generally in the range of 1 to 2, preferably 1 to 1.5, particularly preferably 1.02 to 1.3.

The amount of a polyol-derived structural unit contained in the isocyanate group-containing polyester prepolymer is preferably in the range of 0.5% by mass to 40% by mass, more preferably 1% by mass to 30% by mass, particularly preferably 2% by mass to 20% by mass. When the amount is less than 0.5% by mass, there may be a decrease in hot offset resistance, and it may be difficult to achieve a favorable balance between the heat-resistant storage stability and the low-temperature fixability of the toner. When the amount is more than 40% by mass, there may be a decrease in low-temperature fixability.

The polyisocyanate may be suitably selected according to the intended purpose. Examples thereof include aliphatic diisocyanates, alicyclic diisocyanates, aromatic diisocyanates, aromatic-aliphatic diisocyanates, isocyanurates, and these compounds blocked with phenol derivatives, oximes, caprolactam, etc.

Specific examples of the aliphatic diisocyanates include tetramethylene diisocyanate, hexamethylene diisocyanate, methyl 2,6-diisocyanatocaproate, octamethylene diisocyanate, decamethylene diisocyanate, dodecamethylene diisocyanate, tetradecamethylene diisocyanate, trimethylhexane diisocyanate and tetramethylhexane diisocyanate. Specific examples of the alicyclic diisocyanates include isophorone diisocyanate and cyclohexylmethane diisocyanate. Specific examples of the aromatic diisocyanates include tolylene diisocyanate, diisocyanatodiphenylmethane, 1,5-naphthylene diisocyanate, 4,4'-diisocyanatodiphenyl, 4,4'-diisocyanato-3,3'-dimethyldiphenyl, 4,4'-diisocyanato-3-methyldiphenylmethane and 4,4'-diisocyanato-diphenyl ether. Specific examples of the aromatic-aliphatic diisocyanates include $\alpha,\alpha,\alpha',\alpha'$-tetramethylxylylene diisocyanate. Specific examples of the isocyanurates include tris(isocyanatoalkyl) isocyanurate and tris(isocyanatocycloalkyl)isocyanurate. These may be used individually or in combination.

In the case where a polyisocyanate and a hydroxyl group-containing polyester resin are reacted together, it is generally preferred that the equivalence ratio of the isocyanate group of the polyisocyanate to the hydroxyl group of the polyester resin be in the range of 1 to 5, more preferably 1.2 to 4, particularly preferably 1.5 to 3. When the equivalence ratio is greater than 5, there may be a decrease in low-temperature fixability. When the equivalence ratio is less than 1, there may be a decrease in offset resistance.

The amount of a polyisocyanate-derived structural unit contained in the isocyanate group-containing polyester prepolymer is preferably in the range of 0.5% by mass to 40% by mass, more preferably 1% by mass to 30% by mass, even more preferably 2% by mass to 20% by mass. When the amount is less than 0.5% by mass, there may be a decrease in hot offset resistance. When the amount is more than 40% by mass, there may be a decrease in low-temperature fixability.

The average number of isocyanate groups per molecule of the polyester prepolymer is preferably 1 or more, more preferably in the range of 1.2 to 5, even more preferably 1.5 to 4. When the average number is less than 1, the molecular weight of the urea-modified polyester resin decreases, and there may be a decrease in hot offset, resistance.

Specific examples of the binder resin precursor include a mixture of (i) a polyester prepolymer (obtained by reacting isophorone diisocyanate with a polycondensation product of an ethylene oxide (2 mol) adduct of bisphenol A and isophthalic acid) urea-modified with isophoronediamine, and (ii) a polycondensation product of an ethylene oxide (2 mol) adduct of bisphenol A and isophthalic acid; a mixture of (i) a polyester prepolymer (obtained by reacting isophorone diisocyanate with a polycondensation product of an ethylene oxide (2 mol) adduct of bisphenol A and isophthalic acid) urea-modified with isophoronediamine, and (ii) a polycondensation product of an ethylene oxide (2 mol) adduct of bisphenol A and terephthalic acid; a mixture of (i) a polyester prepolymer (obtained by reacting isophorone diisocyanate with a polycondensation product of an ethylene oxide (2 mol) adduct of bisphenol A, a propylene oxide (2 mol) adduct of bisphenol A and terephthalic acid) urea-modified with isophoronediamine, and (ii) a polycondensation product of an ethylene oxide (2 mol) adduct of bisphenol A, a propylene oxide (2 mol) adduct of bisphenol A and terephthalic acid; a mixture of (i) a polyester prepolymer (obtained by reacting isophorone diisocyanate with a polycondensation product of an ethylene oxide (2 mol) adduct of bisphenol A, a propylene oxide (2 mol) adduct of bisphenol A and terephthalic acid) urea-modified with isophoronediamine, and (ii) a polycondensation product of a propylene oxide (2 mol) adduct of bisphenol A and terephthalic acid; a mixture of (i) a polyester prepolymer (obtained by reacting isophorone diisocyanate with a polycondensation product of an ethylene oxide (2 mol) adduct of bisphenol A and terephthalic acid) urea-modified with hexamethylenediamine, and (ii) a polycondensation product of an ethylene oxide (2 mol) adduct of bisphenol A and terephthalic acid; a mixture of (i) a polyester prepolymer (obtained by reacting isophorone diisocyanate with a polycondensation product of an ethylene oxide (2 mol) adduct of bisphenol A and terephthalic acid) urea-modified with hexamethylenediamine, and (ii) a polycondensation product of an ethylene oxide (2 mol) adduct of bisphenol A, a propylene oxide (2 mol) adduct of bisphenol A and terephthalic acid; a mixture of (i) a polyester prepolymer (obtained by reacting isophorone diisocyanate with a polycondensation product of an ethylene oxide (2 mol) adduct of bisphenol A and terephthalic acid) urea-modified with ethylenediamine, and (ii) a polycondensation product of an ethylene oxide (2 mol) adduct of bisphenol A and terephthalic acid; a mixture of (i) a polyester prepolymer (obtained by reacting diphenylmethane diisocyanate with a polycondensation product of an ethylene oxide (2 mol) adduct of bisphenol A and isophthalic acid) urea-modified with hexamethylenediamine, and (ii) a polycondensation product of an ethylene oxide (2 mol) adduct of bisphenol A and isophthalic acid; a mixture of (i) a polyester prepolymer (obtained by reacting diphenylmethane diisocyanate with a polycondensation product of an ethylene oxide (2 mol) adduct of bisphenol A, a propylene oxide (2 mol) adduct of bisphenol A, terephthalic acid and dodecenyl succinic anhydride) urea-modified with hexamethylenediamine, and (ii) a polycondensation product of an ethylene oxide (2 mol) adduct of bisphenol A, a propylene oxide (2 mol) adduct of bisphenol A and terephthalic acid; and a mixture of (i) a polyester prepolymer (obtained by reacting toluene diisocyanate with a polycondensation product of an ethylene oxide (2 mol) adduct of bisphenol A and isophthalic acid) urea-modified with hexamethylenediamine, and (ii) a polycondensation product of an ethylene oxide (2 mol) adduct of bisphenol A and isophthalic acid.

The weight average molecular weight of the polymer reactive with the active hydrogen group is preferably in the range of 1,000 to 45,000, more preferably 3,000 to 45,000, particularly preferably 1,500 to 15,000. When the weight average molecular weight is less than 1,000, there may be a decrease in heat-resistant storage stability. When the weight average molecular weight is greater than 45,000, there may be a decrease in low-temperature fixability.

<<Active Hydrogen Group-Containing Compound>>

The active hydrogen group-containing compound functions as an elongating agent, a cross-linking agent, etc., when the polymer reactive with the active hydrogen group is subjected to an elongation reaction, a cross-linking reaction, etc. in the aqueous medium.

Examples of the active hydrogen group include hydroxyl groups (alcoholic hydroxyl group and phenolic hydroxyl group), amino groups, a carboxyl group and a mercapto group. These active hydrogen groups may be used individually or in combination.

The active hydrogen group-containing compound may be suitably selected according to the intended purpose. In the case where the polymer reactive with the active hydrogen group is an isocyanate group-containing polyester prepolymer, the active hydrogen group-containing compound is preferably an amine because it can have a high molecular weight by means of an elongation reaction, a cross-lining reaction, etc. with the polyester prepolymer.

The amine is not particularly limited and may be suitably selected according to the intended purpose. Examples thereof include diamines, trivalent or higher amines, amino alcohols, amino mercaptans, amino acids, and compounds obtained by blocking amino groups of these compounds. Preference is given to diamines, and mixtures which are each composed of a diamine and a small amount of a trivalent or higher amine. These may be used individually or in combination.

Examples of the diamines include aromatic diamines, alicyclic diamines and aliphatic diamines. Specific examples of the aromatic diamines include phenylenediamine, diethyltoluenediamine and 4,4'-diaminodiphenylmethane. Specific examples of the alicyclic diamines include 4,4'-diamino-3,3'-dimethyldicyclohexylmethane, diaminocyclohexane and isophoronediamine. Specific examples of the aliphatic diamines include ethylenediamine, tetramethylenediamine and hexamethylenediamine. Examples of the trivalent or higher amines include diethylenetriamine and triethylenetetramine. Specific examples of the amino alcohols include ethanolamine and hydroxyethylaniline. Specific examples of the amino mercaptans include aminoethyl mercaptan and aminopropyl mercaptan. Specific examples of the amino acids include aminopropionic acid and aminocaproic acid. Specific examples of the compounds obtained by blocking the amino groups include oxazolidine compounds and ketimine compounds obtained by blocking the amino groups with ketones such as acetone, methy ethyl ketone and methyl isobutyl ketone.

As for the elongation reaction and the cross-lining reaction between the active hydrogen group-containing compound and the polymer reactive with the active hydrogen group, the following take place: an active hydrogen group-containing compound, a polymer which has a site capable of reacting with the active hydrogen group-containing compound, a colorant and a wax are dissolved or dispersed in an organic solvent, and the solution or the dispersion liquid is dispersed in an aqueous solvent (A step); and the organic solvent is removed after or while the active hydrogen group-containing compound and the polymer which has the site capable of reacting with the active hydrogen group-containing compound are reacted together (B step); regarding a washed and dried toner, the reaction between the active hydrogen group-containing compound and the polymer which has the site capable of reacting with the active hydrogen group-containing compound mainly proceeds in the A and B steps. By controlling the reaction between the active hydrogen group-containing compound and the polymer which has the site capable of reacting with the active hydrogen group-containing compound, it is possible to obtain a toner whose storage elastic modulus is 5,000 Pa or greater at 140° C. Regarding the reaction between the active hydrogen group-containing compound and the polymer which has the site capable, of reacting with the active hydrogen group-containing compound, it is preferred that, in the step of removing the organic solvent, heating be performed at 30° C. to 65° C. when the amount of residual organic solvent is in the range of 2% by mass to 15% by mass. When the amount of the residual organic solvent is less than 2% by mass, the reaction may not sufficiently proceed. When the amount of the residual organic solvent is greater than 15% by mass, toner particles may combine together.

The length of time of the heating is not particularly limited and may be suitably selected according to the intended purpose. The length of time is preferably 30 minutes or longer, more preferably 60 minutes or longer, particularly preferably 120 minutes or longer.

A reaction terminator may be used to stop the elongation reaction, the cross-linking reaction, etc. between the active hydrogen group-containing compound and the polymer reactive with the active hydrogen group. Use of a reaction terminator makes it possible to keep the molecular weight of an adhesive base material, etc. inside desired ranges. Specific examples of the reaction terminator include monoamines such as diethylamine, dibutylamine, butylamine and laurylamine, and ketimine compounds produced by blocking the amino groups of these compounds.

The equivalence ratio of the isocyanate group of the polyester prepolymer to the amino group of the amine is preferably in the range of ⅓ to 3, more preferably ½ to 2, particularly preferably ⅔ to 1.5. When the equivalence ratio is less than ⅓, there may be a decrease in low-temperature fixability. When the equivalence ratio is greater than 3, the molecular weight of the urea-modified polyester resin decreases, and thus there may be a decrease in hot offset resistance.

<Wax>

The amount of the wax present at surfaces of particles of the toner can be measured by FTIR-ATR. According to the measurement principle, the depth for analysis is approximately 0.3 μm. By this analysis, it is possible to work out the amount of the wax present within 0.3 μm in depth from the surfaces of the toner particles.

The intensity ratio of an absorbance at 2,850 $cm^{-1}$ derived from the wax to an absorbance at 828 $cm^{-1}$ derived from the binder resin, represented by "absorbance derived from the wax/absorbance derived from the binder resin", is in the range of 0.1 to 0.5, preferably 0.1 to 0.4, particularly preferably 0.1 to 0.3, where the absorbances are measured by FTIR-ATR after the toner has been heated to 140° C. and then cooled. When the intensity ratio is less than 0.1, the amount of the wax present at the surfaces of the toner particles after the heating of the toner is small, so that the amount of the wax at the surface of an image at the time of fixation is small and the separability between an image and a fixing roller or belt is poor. When the intensity ratio is greater than 0.5, the wax is exposed in large amounts at the surfaces of the toner particles; owing to long-term agitation inside a developing device, the wax easily detaches from the surfaces of the toner particles, and the wax may be attached to surfaces of carrier particles and surfaces of members inside the developing device, causing a decrease in the charge amount of a developer, so that the filming resistance is poor and an image defect may arise. It should be noted that the wax present within 0.3 μm in depth from the surfaces of the toner particles exhibit releasability of the toner effectively, and that the wax seeps to the surfaces of the toner particles upon heating and pressurization at the time of fixation. The intensity ratio can be suitably adjusted to the range of 0.1 to 0.5 by a toner obtained by aqueous granulation and can be more suitably adjusted thereto with the use of a wax dispersant.

The method of measuring the amount of the wax at the surfaces of the toner particles by means of FTIR-ATR is as follows.

First of all, 0.02 g of a toner as a sample is pressed with a load of 600 N for 1 minute in a pellet forming apparatus (TYPE NH-200, manufactured by Nakaseiki Co., Ltd.), and a toner pellet having a diameter of 6 mm (thickness: approximately 1 mm) was thus produced. A value concerning the toner pellet, measured after heating the pellet as described blow, is used as a value concerning the toner after the toner has been heated to 140° C. The microscopic FTIR device used is provided with SPECTRUM ONE MULTISCOPE FTIR UNIT (manufactured by PerkinElmer Inc.), and the measurement is carried out by means of micro ATR with germanium (Ge) crystals which are 100 μm in diameter. The incidence angle of infrared rays is 41.5°, the resolving power is 4 $cm^{-1}$, and the total number of times is 20.

The intensity ratio (P2850/P828) of the absorbance at 2,850 $cm^{-1}$ derived from the wax to the absorbance at 828 $cm^{-1}$ derived from the binder resin is defined as the relative amount of the wax at the surfaces of the toner particles. As the value of the relative amount, the average of relative amounts obtained by carrying out the measurement four times in different places is used.

For the heating of the toner, MOISTURE DETERMINATION BALANCE FD600 is used. The heating temperature is set at 140° C., and as soon as the temperature of the toner has reached 140° C. at a temperature increase rate of 10° C./min, airflow is applied to cool the toner to 40° C. or lower.

The toner pellet is placed on cover glass and then set on the heating surface of FD600. Subsequently, a lid is placed in position, and then heating starts. After cooling, ATR measurement is carried out using part of the released toner pellet, which lies on the opposite side to the cover glass.

Also, the peak intensity ratio (absorbance ($P_{2850}$) at 2,850 $cm^{-1}$ derived from the wax/absorbance ($P_{828}$) at 828 $cm^{-1}$ derived from the binder resin) representing the wax composition of the toner stored in an atmosphere of 23° C., observed by means of FTIR-ATR, is preferably in the range of 0.01 to 0.15, more preferably 0.04 to 0.10. When the intensity ratio is less than 0.01, the rub resistance of a fixed image is poor. When the intensity is greater than 0.15, a carrier is smeared, and further, developer-related blocking arises at high temperatures.

The amount of the wax present within 0.3 μm in depth from the surfaces of the toner particles can be measured from the above-mentioned intensity ratio ($P_{2850}/P_{828}$) and expressed in mass. The following is an example of a method for expressing the amount in mass: pellets are produced by mixing the wax in amounts of 1% by mass, 3% by mass, 5% by mass, 8% by mass and 10% by mass respectively into the polyester resin, and sufficiently and uniformly dispersing the wax using an agate mortar, then the intensity ratio ($P_{2850}/P_{828}$) between the peak at 2,850 $cm^{-1}$ derived from the wax and the peak at 828 $cm^{-1}$ derived from the binder resin is measured by the method based upon FTIR-ATR, subsequently a calibration curve is produced based upon the measurement results, and the amount of the wax at the surfaces can be calculated from the calibration curve.

The amount of the wax included in the toner is not particularly limited and may be suitably selected according to the intended purpose. The amount is preferably in the range of 1% by mass to 10% by mass, more preferably 2% by mass to 6% by mass. When the amount is less than 1% by mass, there may be a decrease in hot offset resistance. When the amount is more than 10% by mass, (owing to long-term agitation inside the developing device) the wax easily detaches from the surfaces of the toner particles, and the wax may be attached to the surfaces of the carrier particles and the surfaces of the members inside the developing device, causing a decrease in the charge amount of the developer, so that the filming resistance is poor and an image defect may arise.

The wax is not particularly limited as long as its polarity is small, and it may be suitably selected from known waxes according to the intended purpose. Examples of the wax include microcrystalline waxes, paraffin waxes, polyethylene waxes, polypropylene waxes, carbonyl group-containing waxes and long-chain hydrocarbons. These may be used individually or in combination. It is preferred that the wax be at least one selected from microcrystalline waxes, paraffin waxes, polyethylene waxes and polypropylene waxes.

The melting point of the wax is not particularly limited and may be suitably selected according to the intended purpose. It is preferably in the range of 65° C. to 95° C., more preferably 65° C. to 90° C., particularly preferably 65° C. to 85° C. When the melting point is lower than 65° C., there may be an adverse effect on the heat-resistant storage stability of the toner. When the melting point is higher than 95° C., cold offset easily arises at the time of low-temperature fixation.

The wax preferably decreases in mass by 10% or less, more preferably 8% or less, particularly preferably 5% or less, at 165° C. When the wax decreases in mass by more than 10% at 165° C., the inside of a machine may be smeared with the wax, and thus abnormal images may be formed.

The melt viscosity of the wax, measured at the temperature which is higher than the melting point of the wax by 20° C., is preferably in the range of 1 cps to 500 cps, more preferably 1 cps to 250 cps. When the melt viscosity is lower than 1 cps, there may be a decrease in toner releasability. When the melt viscosity is higher than 500 cps, the hot offset resistance and the low-temperature fixability may not be able to be improved.

The method for controlling the extent to which the wax is exposed at the surfaces of the toner particles (the above-mentioned intensity ratio ($P_{2850}/P_{828}$) and the ratio of the amount of the wax at the surfaces to the total amount of the wax) is not particularly limited and may be suitably selected according to the intended purpose. A preferred method is inclusion of a vinyl-modified resin in the wax. Here, when the amount of the wax included is denoted by X and the amount of the vinyl-modified resin included is denoted by Y, the mass ratio Y/X is preferably in the range of 0.4 to 3. When the mass ratio Y/X is less than 0.4, the amount of the wax exposed at the surfaces of the toner particles is so large that filming and a so-called "carrier spent phenomenon" (unfavorable attachment of the toner to the surfaces of the carrier particles) may arise and the durability of the developer may be insufficient. When the mass ratio Y/X is greater than 3, most of the wax is dispersed inside the toner particles without being exposed at the surfaces thereof; however, the dispersion diameter of the wax is so small that a sufficient toner releasing effect may not be exhibited at the time of fixation.

The vinyl-modified resin is produced by modifying at least part of a wax with a vinyl monomer whose average ester group concentration is in the range of 8% by mass to 30% by mass. The vinyl-modified resin is composed mainly of a main chain formed of a wax, and a side chain (graft chain) formed of a vinyl polymer. The side chain formed of the vinyl polymer contains an ester group-containing vinyl monomer component whose average ester group concentration is in the range of 8% by mass to 30% by mass relative to the total mass of the side chain formed of the vinyl polymer.

The softening point of the wax contained in the vinyl-modified resin is not particularly limited and may be suitably selected according to the intended purpose. It is generally in the range of 80° C. to 170° C., preferably 90° C. to 160° C. The number average molecular weight (Mn) of the wax contained in the vinyl-modified resin is preferably in the range of 500 to 2,000, more preferably 1,000 to 15,000. The weight average molecular weight (Mw) thereof is preferably in the range of 800 to 100,000, more preferably 1,500 to 60,000. The ratio Mw/Mn is preferably in the range of 1.1 to 7.0, more preferably 1.3 to 4.0.

The glass transition temperature of the vinyl-modified resin is not particularly limited and may be suitably selected according to the intended purpose but is preferably in the range of 40° C. to 90° C., more preferably 50° C. to 70° C. The softening point of the vinyl-modified resin is preferably in the range of 80° C. to 150° C., more preferably 90° C. to 130° C.

The number average molecular weight (Mn) of the vinyl-modified resin is preferably in the range of 1,500 to 100,000, more preferably 2,800 to 20,000. The weight average molecular weight (Mw) thereof is preferably in the range of 60,000 to 100,000, more preferably 50,000 to 70,000. The ratio Mw/Mn is preferably in the range of 1.1 to 40, more preferably 3 to 30.

<Colorant>

The colorant is not particularly limited and may be suitably selected from known dyes and pigments according to the intended purpose. Examples of the colorant include carbon black, nigrosine dyes, iron black, Naphthol Yellow S, Hansa Yellow (10G, 5G, G), cadmium yellow, yellow iron oxide, yellow ocher, yellow lead, titanium yellow, polyazo yellow, oil yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, Anthrazane Yellow BGL, isoindolinone yellow, red ocher, red lead, lead vermilion, cadmium red, cadmium mercury red, antimony vermilion, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, Bon Maroon Light, Bon Maroon Medium, Eosin Lake, Rhodamine Lake B, Rhodamine Lake Y, Alizarine Lake, Thioindigo Red B, Thioindigo Maroon, oil red, quinacridone red, pyrazolone red, polyazo red, chrome vermilion, benzidine orange, perynone orange, oil orange, cobalt blue, cerulean blue, Alkali Blue Lake, Peacock Blue Lake, Victoria Blue Lake, metal-free phthalocyanine blue, phthalocyanine blue, Fast Sky Blue, Indanthrene Blue (RS, BC), indigo, ultramarine, Prussian blue, anthraquinone blue, Fast Violet B, Methyl Violet Lake, cobalt violet, manganese violet, dioxane violet, anthraquinone violet, chrome green, zinc green, chromium oxide, viridian, emerald green, Pigment Green B, Naphthol Green B, Green Gold, Acid Green Lake, Malachite Green Lake, phthalocyanine green, anthraquinone green, titanium oxide, zinc oxide and lithopone. These may be used individually or in combination.

The amount of the colorant included in the toner is not particularly limited and may be suitably selected according to the intended purpose but is preferably in the range of 1% by mass to 15% by mass, more preferably 3% by mass to 10% by mass. When the amount of the colorant is less than 1% by mass, the coloring power of the toner may decrease. When the amount of the colorant is greater than 15% by mass, there may be poor dispersion of a pigment in the toner, so that the coloring power of the toner may decrease and the electrical properties of the toner may degrade.

The colorant may be compounded with a resin to form a masterbatch. This resin is not particularly limited and may be suitably selected from known resins according to the intended purpose. Examples thereof include polymers of styrene or substituted styrene, styrene copolymers, polymethyl methacrylate, polybutyl methacrylate, polyvinyl chloride, polyvinyl acetate, polyethylene, polypropylene, polyesters, epoxy resins, epoxy polyol resins, polyurethanes, polyamides, polyvinyl butyral, polyacrylic acid resins, rosins, modified rosins, terpene resins, aliphatic hydrocarbon resins, alicyclic hydrocarbon resins, aromatic petroleum resins, chlorinated paraffins and paraffins. These may be used individually or in combination.

Examples of the polymers of styrene or substituted styrene include polyester resins, polystyrene, poly-p-chlorostyrene and polyvinyltoluene. Examples of the styrene copolymers include styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-methyl chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer and styrene-maleic acid ester copolymer The masterbatch can be obtained by mixing or kneading the colorant and the resin for use in a masterbatch, with application of high shearing force. In doing so, an organic solvent is preferably added to enhance interaction between the colorant and the resin. Also, the so-called flushing method can be suitably used because wet cake of the colorant can be used without the need to change it and thus drying is not required. The flushing method is a method in which an aqueous paste containing a colorant and water is mixed or kneaded with a resin and an organic solvent and then the colorant is transferred to the resin to remove the water and the organic solvent. For the mixing or kneading, a high shear dispersing apparatus such as a three roll mill is preferably used.

<Toner Material Liquid>

The toner material liquid is produced by dissolving or dispersing, in an oily medium, materials constituting the toner. The materials constituting the toner are not particularly limited as long as they can form the toner, and they may be suitably selected according to the intended purpose. For example, the materials include at least a wax, a colorant, and any of a monomer, a polymer, an active hydrogen group-containing compound and a polymer (prepolymer) capable of reacting with the active hydrogen group-containing compound. If necessary, the materials may further include other components such as a wax dispersant and a charge controlling agent.

In a toner producing method according to a preferred embodiment of the present invention, the toner material liquid can be prepared by dissolving or dispersing, in an oily medium, toner materials such as an active hydrogen group-containing compound, a polymer capable of reacting with the active hydrogen group-containing compound, a wax, a colorant and a charge controlling agent. The toner-constituting materials except the polymer (prepolymer) capable of reacting with the active hydrogen group-containing compound may be added and mixed into an aqueous medium in the preparation of the aqueous medium described later, or added into the aqueous medium along with the toner material liquid when the toner material liquid is added to the aqueous medium.

—Oily Medium—

The oily medium is a solvent in which the materials constituting the toner can be dissolved or dispersed, and the solvent preferably contains an organic solvent. The organic solvent is preferably removed while or after base particles of the toner are formed. In view of its easy removal, the organic solvent is preferably volatile, having a boiling point of lower than 150° C. When the organic solvent has a boiling point of 150° C. or higher, aggregation of toner particles may occur when it is removed. Examples of the solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. Preferable among these are toluene, xylene, benzene, methylene chloride, 1,2-dichloroethane, chloroform, carbon tetrachloride and the like, particularly ethyl acetate. These may be used individually or in combination.

The amount of the organic solvent used is not particularly limited and may be suitably selected according to the intended purpose. The amount is preferably in the range of 40 parts by mass to 300 parts by mass, more preferably 60 part by mass to 140 parts by mass, particularly preferably 80 parts by mass to 120 parts by mass, per 100 parts by mass of the toner materials.

—Wax Dispersant—

The wax dispersant is not particularly limited as long as it allows the wax to be uniformly dispersed in the toner particles, and it may be suitably selected according to the intended purpose. Basically, a material including a site which has high affinity for the wax and also including a site which has high affinity for the binder resin is used. Examples thereof include a wax dispersant produced by graft-polymerizing a polyolefin wax (such as polyethylene or polypropylene) with a styrene-acrylic based compound.

The amount of the wax dispersant is preferably in the range of 10 parts by mass to 300 parts by mass, more preferably 10 parts by mass to 100 parts by mass, particularly preferably 30 parts by mass to 80 parts by mass, per 100 parts by mass of the wax. When the amount of the wax dispersant is less than 10 parts by mass, the wax may be poorly dispersed in the toner, and the amount of the wax at the surfaces of the toner particles may increase. When the amount of the wax dispersant is greater than 300 parts by mass, the offset-preventing capability may be insufficient.

—Charge Controlling Agent—

The charge controlling agent is not particularly limited and may be suitably selected according to the intended purpose. Nevertheless, use of a material which is colorless or has a color similar to white is preferable because if a colored material is used, there may be a change in color tone. Specific examples of the charge controlling agent include triphenylmethane dyes, molybdic acid chelate pigments, rhodamine dyes, alkoxyamines, quaternary ammonium salts (including fluorine-modified quaternary ammonium salts), alkylamides, phosphorus, phosphorus compounds, tungsten, tungsten compounds, fluorochemical surfactants, metal salts of salicylic acid, and metal salts of salicylic acid derivatives. These may be used individually or in combination.

The charge controlling agent may be a commercially available product, and examples of the commercially available product include BONTRON P-51 (quaternary ammonium salt), E-82 (oxynaphthoic acid-based metal complex), E-84 (salicylic acid-based metal complex) and E-89 (phenolic condensate) (manufactured by ORIENT CHEMICAL INDUSTRIES CO., LTD.); TP-302 and TP-415 (quaternary ammonium salt molybdenum complexes) (manufactured by HODOGAYA CHEMICAL CO., LTD.); COPY CHARGE PSY VP2038 (quaternary ammonium salt), COPY BLUE PR (triphenylmethane derivative), COPY CHARGE NEG VP2036 and COPY CHARGE NX VP434 (quaternary ammonium salts) (manufactured by Hoechst AG); LRA-901, and LR-147 (boron complex) (manufactured by Japan Carlit Co., Ltd.); quinacridone, azo-based pigments, and polymers containing functional groups such as sulfonic acid group and carboxyl group, or quaternary ammonium salts.

The charge controlling agent may be dissolved or dispersed after melt-kneaded with the masterbatch, or may be dissolved or dispersed along with the components of the toner in a solvent, or may be fixed to the surface of the toner after the toner has been produced.

The amount of the charge controlling agent in the toner varies depending upon the type of the binder resin used, the presence or absence of additive(s), the dispersing process employed, etc. and therefore cannot be unequivocally defined. Nevertheless, the amount is preferably in the range of 0.1% by mass to 10% by mass, more preferably 0.2% by mass to 5% by mass, relative to the amount of the binder resin. When the amount of the charge controlling agent is less than 0.1% by mass, favorable charge controlling properties may not be obtained. When the amount thereof is greater than 10% by mass, the chargeability of the toner is so great that the electrostatic attraction between the toner and a developing roller increases, thereby possibly leading to degradation of the fluidity of the developer and a decrease in image density.

—Resin Particles—

Regarding the resin particles, the resin used therefor is not particularly limited as long as it is capable of forming an aqueous dispersion liquid in an aqueous medium, and it may be suitably selected from known resins according to the intended purpose. The resin may be a thermoplastic resin or may be a thermosetting resin. Specific examples of the resin include vinyl resins, polyurethane resins, epoxy resins, polyester resins, polyamide resins, polyimide resins, silicon resins, phenol resins, melamine resins, urea resins, aniline resins, ionomer resins and polycarbonate resins. Among these resins, preference is given to one or more resins selected from the groups consisting of vinyl resins, polyurethane resins, epoxy resins and polyester resins, since an aqueous dispersion liquid of fine spherical resin particles can be easily obtained. These may be used individually or in combination.

Parenthetically, the vinyl resins are resins which are obtained by homopolymerizing or copolymerizing vinyl monomers. Specific examples of the vinyl resins include styrene-(meth)acrylic acid ester copolymer, styrene-butadiene copolymer, (meth)acrylic acid-acrylic acid ester copolymer, styrene-acrylonitrile copolymer, styrene-maleic anhydride copolymer and styrene-(meth)acrylic acid copolymer.

Also, as the resin particles, particles of a copolymer obtained by polymerizing a monomer which contains a plurality of unsaturated groups can be used as well. The monomer which contains a plurality of unsaturated groups can be suitably selected according to the intended purpose, and specific examples thereof include a sodium salt of methacrylic acid ethylene oxide adduct sulfate (ELEMINOL RS-30, manufactured by Sanyo Chemical Industries, Ltd.), divinylbenzene and 1,6-hexanediol diacrylate.

The resin particles can be obtained by means of polymerization using a known method; it is preferable to use an aqueous dispersion liquid of resin particles. Examples of methods of preparing the aqueous dispersion liquid of resin particles include: (in the case of a vinyl resin) a method of producing an aqueous dispersion liquid of resin particles by polymerizing a vinyl monomer, using a suspension polymerization method, an emulsion polymerization method, a seed polymerization method or a dispersion polymerization method; (in the case of a polyaddition or condensation resin such as a polyester resin, polyurethane resin or epoxy resin) a method of dispersing a precursor such as a monomer or oligomer, or a solution thereof into an aqueous medium in the presence of a certain dispersant and then curing it with application of heat or addition of a curing agent so as to produce an aqueous dispersion liquid of resin particles, a method of dissolving a certain emulsifier in a precursor such as a monomer or oligomer, or a solution thereof and then adding water so as to effect phase inversion emulsification; a method of pulverizing and classifying a resin with the use of a mechanical rotary type, jet-type, etc. fine pulverizer so as to obtain resin particles and then dispersing the resin particles into water in the presence of a certain dispersant, a method of spraying a resin solution in the form of mist so as to obtain resin particles and then dispersing the resin particles into water in the presence of a certain dispersant, a method of precipitating resin particles by adding a poor solvent to a resin solution or by cooling a resin solution dissolved in a solvent with heating, then removing the solvent so as to obtain resin particles, and subsequently dispersing the resin particles into water in the presence of a certain dispersant, a method of dispersing a resin solution into an aqueous medium in the presence of a certain dispersant and then carrying out heating, pressure reduction, etc. so as to remove the solvent, and a method of dissolving a certain emulsifier into a resin solution and then adding water so as to effect phase inversion emulsification.

The amount of the resin particles included in the toner is preferably in the range of 0.5% by mass to 10% by mass, more preferably 1% by mass to 5% by mass.

—Inorganic Particles—

The inorganic particles are not particularly limited and may be suitably selected from known inorganic particles according to the intended purpose. Specific examples thereof include particles of silica, alumina, titanium oxide, barium titanate, magnesium titanate, calcium titanate, strontium titanate, zinc oxide, tin oxide, silica sand, clay, mica, wollastonite, diatom earth, chromium oxide, cerium oxide, red ochre, antimony trioxide, magnesium oxide, zirconium oxide, barium sulfate, barium carbonate, calcium carbonate, silicon carbide and silicon nitride. These may be used individually or in combination.

The primary particle diameter of the inorganic particles is preferably in the range of 5 nm to 2 μm, more preferably 5 nm to 500 nm. The specific surface area of the inorganic particles, measured by the BET method, is preferably in the range of 20 $m^2/g$ to 500 $m^2/g$.

The amount of the inorganic particles included in the toner is preferably in the range of 0.01% by mass to 5% by mass, more preferably 0.1% by mass to 2.0% by mass.

—Fluidity Improver—

When surface treatment is performed using the fluidity improver, the hydrophobicity of the toner surface improves, and degradation of the fluidity and chargeability of the toner can be suppressed even at high humidity. Specific examples of the fluidity improver include silane coupling agents, silylating agents, alkyl fluoride group-containing silane coupling agents, organic titanate-based coupling agents, aluminum-based coupling agents, silicone oils and modified silicone oils.

—Cleanability Improver—

Addition of the cleanability improver to the toner makes it easier to remove the developer which remains on a photoconductor and/or on a primary transfer medium after image transfer. Specific examples of the cleanability improver include fatty acid metal salts such as zinc stearate, calcium stearate and stearic acid, and resin particles obtained by soap-free emulsion polymerization or the like, such as polymethyl methacrylate particles and polystyrene particles. The particle size distribution of the resin particles is preferably narrow, and the volume average particle diameter thereof is preferably in the range of 0.01 μm to 1 μm.

—Magnetic Material—

The magnetic material is not particularly limited and may be suitably selected from known magnetic materials according to the intended purpose. Examples thereof include iron powder, magnetite and ferrite. Among these, white magnetic materials are preferable in terms of color tone.

(Toner Producing Method)

The toner producing method is not particularly limited and may be suitably selected according to the intended purpose. Examples thereof include polymerization methods (suspension polymerization method and emulsion polymerization method) in which an oil phase containing at least a binder resin, a colorant and a wax is suspended in an aqueous medium so as to form particles, a pulverization method, a polyaddition reaction method in which a composition containing a specific crystalline polymer and an isocyanate group-containing prepolymer is directly elongated and/or cross-linked with an amine in an aqueous phase, a polyaddition reaction method using an isocyanate group-containing prepolymer, a method of dissolving a material in solvent, removing the solvent and carrying out pulverization, and a melt-spraying method.

In a method of forming particles of a toner by dispersing an oil phase and/or primary particles of a toner composition into an aqueous medium, the presence and biased distribution of materials in the toner are greatly affected by the polarity of the aqueous medium, the polarity of the materials, and monomer(s) and a solvent constituting the oil phase.

For instance, when a comparison between the binder resin and the wax is made, the wax tends to have lower polarity. Generally, materials having polarities closer to that of the aqueous medium relatively tend to be present in a biased manner in the vicinities of the surface sides of toner particles, although the tendency depends also upon the types of the monomer(s) and the solvent constituting the oil phase. Therefore, in the case where the binder resin of the toner has high polarity while the wax has particularly low polarity, the wax tends to be present in a biased manner in the vicinities of the centers of the toner particles and also tends to be encapsulated in the binder resin.

Since the binder resin and the wax often have such properties and tendencies, suitable selection of the properties (e.g., polarities and effects derived from substituent(s)) of the binder resin and the wax makes it possible to attain the presence state of the wax prescribed in the present invention.

Regarding the binder resin, elements which greatly affect its polarity include its acid value and hydroxyl value. Selection of the acid value and the hydroxyl value of the binder resin determines, for example, the state of its affinity for the aqueous medium and the wax.

Meanwhile, the wax often has low polarity in comparison with the binder resin. Therefore, regarding the wax, apart from the view point of its polarity, its dispersed state in the binder resin can be suitably created by the wax dispersant optionally added so as to improve its dispersibility and affinity with respect to the binder resin; the type and amount of the wax dispersant also greatly affect the dispersibility of the wax with respect to the binder resin. Suitably changing the type of the wax, the type of the wax dispersant and their amounts makes it possible to create a state in which a wax domain is encapsulated in the binder resin. Thus, it is possible to reduce the wax component exposed at the surfaces of the toner particles and create a state where the wax is present in the toner particles in such a manner as to be able to seep out of the surfaces thereof depending upon how heating is performed.

To increase the extent to which the wax is encapsulated in the toner particles, there is, for example, a method in which the amount of the wax dispersant is adjusted to the range of 10% by mass to 300% by mass per 100% by mass of the wax, the acid value of the binder resin is adjusted to the range of 12 mgKOH/g to 30 mgKOH/g, and a wax having low polarity is used.

The dispersibility and affinity of the wax with respect to the binder resin are also greatly affected by the dispersion diameter of the wax. When the dispersion diameter of the wax is large, there is a possibility that the amount of the wax in the vicinities of the surfaces of the toner particles is large; consequently, the extent to which the wax is present in a biased manner is great.

Also, in the case of a production method in which toner particles are formed by aggregating primary particles of a toner composition, such as an emulsification aggregation method, it is possible to form toner particles with ease by carrying out the aggregation in multiple steps so as to reduce the primary particles including a wax at the outermost surface layer, or by preparing primary particles, formed by covering the surroundings of wax primary particles with a binder resin, for primary particles before aggregated.

Regarding the toner producing method based upon the polymerization methods, a method of forming toner base particles while producing an adhesive base material will be described below. Such a method involves preparation of an aqueous medium phase, preparation of a liquid containing toner materials, emulsification or dispersion of the toner materials, production of an adhesive base material, removal of a solvent, synthesis of a polymer reactive with an active hydrogen group, and synthesis of an active hydrogen group-containing compound.

The aqueous medium phase can be prepared by dispersing resin particles into an aqueous medium. The amount of the resin particles added into the aqueous medium is preferably in the range of 0.5% by mass to 10% by mass.

The liquid containing the toner materials can be prepared by dissolving or dispersing, in a solvent, toner materials such as an active hydrogen group-containing compound, a polymer reactive with the active hydrogen group, a pigment, a wax, a charge controlling agent and an unmodified polyester resin.

The toner materials other than the polymer reactive with the active hydrogen group may be added and mixed into the aqueous medium when the resin particles are dispersed into the aqueous medium, or may be added into the aqueous medium when the liquid containing the toner materials is added to the aqueous medium.

The toner materials can be emulsified or dispersed by dispersing the liquid containing the toner materials into the aqueous medium. An adhesive base material is produced by subjecting the active hydrogen group-containing compound and the polymer reactive with the active hydrogen group to an elongation reaction and/or a cross-linking reaction when the toner materials are emulsified or dispersed.

For instance, an adhesive base material of a urea-modified polyester resin or the like may be produced by emulsifying or dispersing a liquid which contains a polymer reactive with an active hydrogen group, such as an isocyanate group-containing polyester prepolymer, in an aqueous medium along with an active hydrogen group-containing compound such as an amine, and subjecting the polymer-containing liquid and the compound to an elongation reaction and/or a cross-linking reaction in the aqueous medium; the adhesive base material may be produced by emulsifying or dispersing a liquid which contains toner materials in an aqueous medium to which an active hydrogen group-containing compound has previously been added, and subjecting the liquid and the compound to an elongation reaction and/or a cross-linking reaction in the aqueous medium; or the adhesive base material may be produced by emulsifying or dispersing a liquid which contains toner materials in an aqueous medium, then adding an active hydrogen group-containing compound, and subjecting the liquid and the compound to an elongation reaction and/or a cross-linking reaction based upon particle interfaces in the aqueous medium. Additionally, in the case where the liquid and the compound are subjected to an elongation reaction and/or a cross-linking reaction based upon particle interfaces, the urea-modified polyester resin is formed preferentially at the surface of the toner produced, which makes it possible to provide a concentration gradient of the urea-modified polyester resin in the toner.

The reaction conditions for the production of the adhesive base material may be suitably selected according to the combination of the active hydrogen group-containing compound and the polymer reactive with the active hydrogen group.

Methods of stably forming a dispersion liquid which contains a polymer capable of reacting with an active hydrogen group, such as an isocyanate group-containing polyester prepolymer, include a method in which a liquid prepared by dissolving or dispersing, in a solvent, toner materials such as a polymer reactive with an active hydrogen group, a pigment, a pigment dispersant, a wax, a charge controlling agent and an unmodified polyester resin is added into an aqueous medium phase and dispersed by means of shearing force.

The dispersion can be performed using a known dispersing machine, etc. Examples of the dispersing machine include low-speed shear dispersing machines, high-speed shear dispersing machines, frictional dispersing machines, high-pressure jet dispersing machines and ultrasonic dispersing machines. Preference is given to high-speed shear dispersing machines, since the particle diameter of a dispersion can be adjusted to the range of 2 μm to 20 μm.

In the case where a high-speed shear dispersing machine is used, conditions such as the rotational speed, the dispersion time and the dispersion temperature may be suitably selected according to the intended purpose. The rotational speed is preferably in the range of 1,000 rpm to 30,000 rpm, more preferably 5,000 rpm to 20,000 rpm. The dispersion time is preferably in the range of 0.1 minutes to 5 minutes in the case of a batch type. The dispersion temperature is preferably 150° C. or lower, more preferably in the range of 40° C. to 98° C., under pressure. Note that, in general, the dispersion can be facilitated when the dispersion temperature is high.

The amount of the aqueous medium used when the toner materials are emulsified or dispersed is preferably in the range of 50 parts by mass to 2,000 parts by mass, more preferably 100 parts by mass to 1,000 parts by mass, per 100 parts by mass of the toner materials. When the amount thereof used is less than 50 parts by mass, the dispersed state of the toner materials may degrade, possibly making it impossible to obtain toner base particles with a predetermined particle diameter. When the amount thereof used is greater than 2,000 parts by mass, there may be an increase in production costs.

In the step of emulsifying or dispersing the liquid containing the toner materials, use of a dispersant is preferable in that a dispersion such as oil droplets can be stabilized and made to have a desired shape and the particle size distribution can be sharpened.

The dispersant may be suitably selected according to the intended purpose. Examples thereof include surfactants, inorganic compound dispersants which are sparingly soluble in water, and polymeric protective colloids, with preference being given to surfactants. These may be used individually or in combination.

Examples of the surfactants include anionic surfactants, cationic surfactants, nonionic surfactants and amphoteric surfactants.

Examples of the anionic surfactants include alkylbenzene sulfonates, α-olefin sulfonates and phosphoric acid esters, with preference being given to fluoroalkyl group-containing anionic surfactants. Examples of the fluoroalkyl group-containing anionic surfactants include fluoroalkyl(C2-C10)carboxylic acids or metal salts thereof, disodium perfluorooctanesulfonylglutamate, sodium 3-[ω-fluoroalkyl(C6-C11)oxy]-1-alkyl(C3-C4)sulfonate, sodium 3-[ω-fluoroalkanoyl(C6-C8)-N-ethylamino]-1-propanesulfonate, fluoroalkyl(C11-C20)carboxylic acids or metal salts thereof, perfluoroalkylcarboxylic acids (C7-C13) or metal salts thereof, perfluoroalkyl(C4-C12)sulfonic acids or metal salts thereof, perfluorooctanesulfonic acid diethanolamide, N-propyl-N-(2-hydroxyethyl)perfluorooctanesulfonamide, perfluoroalkyl(C6-C10)sulfonamide propyltrimethylammonium salts, perfluoroalkyl(C6-C10)-N-ethylsulfonylglycine salts and monoperfluoroalkyl(C6-C16)ethyl phosphoric acid esters.

Examples of the fluoroalkyl group-containing anionic surfactants as commercially available products include SURFLON S-111, S-112 and S-113 (manufactured by Asahi Glass Co., Ltd.); FLUORAD FC-93, FC-95, FC-98 and FC-129 (manufactured by Sumitomo 3M Limited); UNIDYNE DS-101 and DS-102 (manufactured by DAIKIN INDUSTRIES, LTD.); MEGAFAC F-110, F-120, F-113, F-191, F-812 and F-833 (manufactured by Dainippon Ink And Chemicals, Incorporated); ECTOP EF-102, 103, 104, 105, 112, 123A, 123B, 306A, 501, 201 and 204 (manufactured by Tochem Products Co., Ltd.); and FTERGENT 100 and 150 (manufactured by NEOS COMPANY LIMITED).

Examples of the cationic surfactants include amine salt surfactants such as alkylamine salts, aminoalcohol fatty acid derivatives, polyamine fatty acid derivatives and imidazoline; and quaternary ammonium salt surfactants such as alkyltrimethyl ammonium salts, dialkyl dimethyl ammonium salts, alkyl dimethyl benzyl ammonium salts, pyridinium salts, alkyl isoquinolinium salts and benzetonium chloride. Preferable among these are fluoroalkyl group-containing aliphatic primary, secondary or tertiary amine acids, aliphatic quaternary ammonium salts such as perfluoroalkyl(C6-C10)sulfonamide propyltrimethylammonium salts, benzalkonium salts, benzethonium chloride, pyridinium salts, imidazolinium salts and the like. Preferred examples of the cationic surfactants as commercially available products include SURFLON S-121 (manufactured by Asahi Glass Co., Ltd.), FLUORAD FC-135 (manufactured by Sumitomo 3M Limited), UNIDYNE DS-202 (manufactured by DAIKIN INDUSTRIES, LTD.), MEGAFAC F-150 and F-824 (manufactured by Dainippon Ink And Chemicals, Incorporated), ECTOP EF-132 (manufactured by Tochem Products Co., Ltd.), and FTERGENT F-300 (manufactured by NEOS COMPANY LIMITED).

Examples of the nonionic surfactants include fatty acid amide derivatives and polyhydric alcohol derivatives.

Examples of the amphoteric surfactants include alanine, dodecyldi(aminoethyl)glycine, di(octylaminoethyl)glycine and N-alkyl-N,N-dimethylammoniumbetaine.

Examples of the inorganic compound dispersants which are sparingly soluble in water include tricalcium phosphate, calcium carbonate, titanium oxide, colloidal silica and hydroxyappetite.

Examples of the polymeric protective colloids include homopolymers or copolymers (obtained by polymerizing, for example, a carboxyl group-containing monomer, a hydroxyl group-containing alkyl (meth)acrylate, a vinyl ether, a vinyl carboxylate, an amide monomer, a monomer of an acid chloride, a monomer containing a nitrogen atom or a heterocyclic ring thereof, etc.), polyoxyethylene resins and celluloses. Note that the homopolymers or the copolymers, obtained by polymerizing the above-mentioned monomers, include those having structural units derived from vinyl alcohol.

Examples of the carboxyl group-containing monomer include acrylic acid, methacrylic acid, α-cyanoacrylic acid, α-cyanomethacrylic acid, itaconic acid, crotonic acid, fumaric acid, maleic acid and maleic anhydride. Examples of the hydroxyl group-containing (meth)acrylic monomer include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycol monoacrylate, diethylene glycol monomethacrylate, glycerin monoacrylate and glycerin monomethacrylate. Examples of the vinyl ether include vinyl methyl ether, vinyl ethyl ether and vinyl propyl ether. Examples of the vinyl carboxylate include vinyl acetate, vinyl propionate and vinyl butyrate. Examples of the amide monomer include acrylamide, methacrylamide, diacetone acrylamide, N-methylolacrylamide and N-methylolmethacrylamide. Examples of the monomer of an acid chloride include acrylic acid chloride and methacrylic acid chloride. Examples of the monomer containing a nitrogen atom or a heterocyclic ring thereof include vinyl pyridine, vinyl pyrolidone, vinyl imidazole and ethyleneimine. Examples of the polyoxyethylene resins include polyoxyethylene, polyoxypropylene, polyoxyethylene alkylamine, polyoxypropylene alkylamine, polyoxyethylene alkylamide, polyoxypropylene alkylamide, polyoxyethylene nonyl phenyl ether, polyoxyethylene lauryl phenyl ether, polyoxyethylene phenyl stearate and polyoxyethylene phenyl pelargonate. Examples of the celluloses include methyl cellulose, hydroxyethyl cellulose and hydroxypropyl cellulose.

If necessary, a dispersant may be used when the toner materials are emulsified or dispersed. Examples of the dispersant include compounds soluble in acids and/or alkalis, such as calcium phosphate salts. In the case where a calcium phosphate salt is used as the dispersant, the calcium phosphate salt can be removed, for example, by a method of dissolving the calcium salt in hydrochloric acid or the like and carrying out washing with water, or by a method of decomposition with an enzyme.

In the elongation reaction and/or the cross-linking reaction employed when the adhesive base material is produced, a catalyst may be used. Specific examples of the catalyst include dibutyltin laurate and dioctyltin laurate.

Methods for removing an organic solvent from a dispersion liquid such as an emulsified slurry include a method of gradually increasing the temperature of the reaction system and thusly evaporating an organic solvent in oil droplets, and a method of spraying a dispersion liquid into a dry atmosphere and thusly removing an organic solvent in oil droplets.

When the organic solvent has been removed, toner base particles are formed. The toner base particles can be washed, dried, etc., and further, can be classified, etc. The classification may be performed by removing fine particles in a liquid by means of a cyclone classifier, a decanter, centrifugation, etc. or may be performed after the drying.

The obtained toner base particles may be mixed with particles of the colorant, the wax, the charge controlling agent, etc. On this occasion, by applying mechanical impact, it is possible to suppress detachment of particles of the wax, etc. from the surfaces of the toner base particles.

Examples of methods of applying mechanical impact include a method of applying impact to the mixture with the use of blades which rotate at high speed, and a method of pouring the mixture into high-speed airflow and accelerating the mixture such that particles collide with one another or that the particles collide with a certain collision plate. Examples of apparatuses for use in these methods include ANGMILL (manufactured by Hosokawa Micron Corporation), an apparatus made by modifying I-type Mill (manufactured by Nippon Pneumatic Mfg. Co., Ltd.) with reduced pulverization air pressure, HYBRIDIZATION SYSTEM (manufactured by Nara Machinery Co., Ltd.), KRYPTRON SYSTEM (manufactured by Kawasaki Heavy Industries, Ltd.), and an automatic mortar.

The toner of the present invention can be used in a variety of fields, notably in electrophotographic image formation.

The volume average particle diameter of the toner of the present invention is preferably in the range of 1 μm to 7 μm, more preferably 3 μm to 6 μm. When the volume average particle diameter is less than 1 μm, (in the case of a two-component developer) the toner may melt and stick to the carrier surface when agitation is carried out over a long period of time in the developing device, thereby possibly decreasing the chargeability of the carrier. When the volume average particle diameter is greater than 7 μm, it is difficult to obtain high-resolution, high-quality images, so that when the toner in the developer is supplied and consumed, the toner may greatly vary in particle diameter.

The ratio of the volume average particle diameter to the number average particle diameter of the toner of the present invention, represented by "volume average particle diameter/number average particle diameter", is preferably in the range of 1.00 to 1.25, more preferably 1.05 to 1.25. Accordingly, in the case of a two-component developer, (even when the toner is supplied and consumed over a long period of time) the particle diameter of the toner in the developer does not vary much, and (even when agitation is carried out over a long period of time in the developing device) favorable, stable develop ability can be achieved. Meanwhile, in the case of a one-component developer, (even when the toner is supplied and consumed) the particle diameter of the toner does not vary much, the chance of the toner forming a film over the developing roller or melting and sticking to a member such as a blade for decreasing the thickness of a toner layer is reduced, and (even when the developing device is used over a long period of time or agitation is carried out therein over a long period of time) favorable, stable developability can be achieved, which makes it possible to obtain high-quality images. When the foregoing ratio is greater than 1.25, it is difficult to obtain high-resolution, high-quality images, and when the toner in the developer is supplied and consumed, the toner may greatly vary in particle diameter.

Here, the volume average particle diameter, and the ratio of the volume average particle diameter to the number average particle diameter can be measured as follows, using MULTISIZER III (manufactured by Beckman Coulter, Inc.). First, 0.1 mL to 5 mL of a surfactant, e.g. an alkylbenzene sulfonate, is added as a dispersant into 100 mL to 150 mL of an electrolytic aqueous solution such as an approximately 1% (by mass) sodium chloride aqueous solution. Next, 2 mg to 20 mg of a measurement sample is added. The electrolytic aqueous solution with the measurement sample suspended therein is subjected to dispersion treatment for 1 minute to 3 minutes using an ultrasonic dispersing machine, then the volume and number of the toner (particles) are measured with an aperture of 100 μm, and the volume distribution and the number distribution are calculated. The volume average particle diameter and the number average particle diameter can be determined based upon the obtained distributions.

The penetration of the toner is preferably 15 mm or greater, more preferably in the range of 20 mm to 30 mm. When the penetration is less than 15 mm, the heat-resistant storage stability of the toner degrades.

Here, the penetration can be measured in accordance with a penetration test (JIS K2235-1991). Specifically, the toner is supplied so as to fill a 50 mL glass container, and then left to stand for 20 hours in a constant temperature bath set at a temperature of 50° C.; thereafter, the toner is cooled to room temperature and subjected to a penetration test. Note that the greater the value of the penetration is, the more favorable the heat-resistant storage stability is.

It is preferred that the fixation lower limit temperature of the toner of the present invention be low and the temperature at which offset does not yet arise be high, in view of a favorable balance between the low-temperature fixability and the offset resistance of the toner. Accordingly, it is preferred that the fixation lower limit temperature be lower than 140° C. and the temperature at which offset does not yet arise be 200° C. or higher. Here, the fixation lower limit temperature is the lower limit of the fixation temperature at which the residual rate of the image density of an obtained image after rubbed with a pad is 70% or more. The temperature at which offset does not yet arise can be determined by measuring the temperature at which offset does not arise, using an image forming apparatus adjusted such that an image is developed with a predetermined amount of the toner.

The thermal properties of the toner, referred to also as "flow tester properties", are evaluated based upon the softening temperature, the flow start temperature, the ½ method softening point, etc. of the toner. These thermal properties can be measured by suitably selected methods and can be measured using the elevated flow tester CFT500 (manufactured by SHIMADZU CORPORATION), etc.

The softening temperature of the toner is preferably 30° C. or higher, more preferably in the range of 50° C. to 90° C. When the softening temperature is lower than 30° C., the heat-resistant storage stability of the toner may degrade.

The flow start temperature of the toner of the present invention is preferably 60° C. or higher, more preferably in the range of 80° C. to 120° C. When the flow start temperature is lower than 60° C., at least one of the heat-resistant storage stability and the offset resistance of the toner may degrade.

The ½ method softening point of the toner of the present invention is preferably 90° C. or higher, more preferably in the range of 100° C. to 170° C. When the ½ method softening point is lower than 90° C., the offset resistance of the toner may degrade.

The glass transition temperature of the toner of the present invention is preferably in the range of 40° C. to 70° C., more preferably 45° C. to 65° C. When the glass transition temperature is lower than 40° C., the heat-resistant storage stability of the toner is favorable and does not degrade. When the glass transition temperature is higher than 70° C., the low-temperature fixability of the toner may be insufficient. The glass transition temperature can be measured using the differential scanning calorimeter DSC-60 (manufactured by SHIMADZU CORPORATION) or the like.

The density of an image formed using the toner of the present invention is preferably 1.40 or greater, more preferably 1.45 or greater, even more preferably 1.50 or greater. When the image density is less than 1.40, the image density is so low that a high quality image may not be able to be obtained. The image density can be measured as follows: a tandem color image forming apparatus (IMAGIO NEO 450, manufactured by Ricoh Company, Ltd.) is used; the surface temperature of the fixing roller is set at 160° C.±2° C.; a solid image is formed on the copy paper TYPE 6200 (manufactured by Ricoh Company, Ltd.), with the amount of the developer attached being 0.35 mg/cm$^2$±0.02 mg/cm$^2$; the image density is measured in any five places on the obtained solid image, using the spectrometer 938 SPECTRODENSITOMETER (manufactured by X-Rite, Inc.); and the obtained image densities are averaged.

The color of the toner of the present invention may be suitably selected according to the intended purpose. The color can be at least one selected from the group consisting of black, cyan, magenta and yellow. The toners of each color can be obtained by suitably selecting respective colorants.

(Developer)

The developer includes the toner of the present invention and may further include suitably selected other components such as a carrier. Thus, high-quality images superior in transferability, chargeability, etc. can be stably formed. The developer may be a one-component developer or may be a two-component developer. It should, however, be noted that in the case where the developer is used in a high-speed printer, etc. adaptable to the present-day increase in information processing speed, the developer is preferably a two-component developer because its lifetime can lengthen.

In the case where the developer is used as a one-component developer, (even when the toner is supplied and consumed) the particle diameter of the toner does not vary much, the chance of the toner forming a film over the developing roller or melting and sticking to the member such as a blade for decreasing the thickness of a toner layer is reduced, and (even when agitation is carried out over a long period of time in the developing device) favorable, stable developability and images can be obtained.

In the case where the developer is used as a two-component developer, (even when the toner is supplied and consumed over a long period of time) the particle diameter of the toner does not vary much, and (even when agitation is carried out over a long period of time in the developing device) favorable, stable developability and images can be obtained.

The carrier may be suitably selected according to the intended purpose, and the carrier preferably includes a core material, and a resin layer which covers the core material.

The material for the core material may be suitably selected from known materials. Examples thereof include manganese-strontium materials (50 emu/g to 90 emu/g) and manganese-magnesium materials (50 emu/g to 90 emu/g). To secure an appropriate image density, use of a highly magnetized material such as iron powder (100 emu/g or greater) or magnetite (75 emu/g to 120 emu/g) is preferable. Also, use of a weakly magnetized material such as a copper-zinc material (30 emu/g to 80 emu/g) is preferable in that the impact which developer particles in an upright position have on the photoconductor can be lessened and the image quality can be advantageously increased. These materials may be used individually or in combination.

The volume average particle diameter of the core material is preferably in the range of 10 μm to 150 μm, more preferably 40 μm to 100 μm. When the volume average particle diameter is less than 10 μm, fine powder exists in large amounts in the carrier, which causes a decrease in magnetization per particle and resultant scattering of the carrier. When the volume average particle diameter is greater than 150 μm, the specific surface area of the carrier decreases, thereby possibly causing scattering of the toner and (especially in the case of full-color images largely occupied by solid portions) possibly degrading reproduction of the solid portions.

The material for the resin layer is not particularly limited and may be suitably selected from known resins according to the intended purpose. Examples thereof include amino resins; polyvinyl resins; polystyrene resins; polyhalogenated olefins; polyester resins; polycarbonate resins; polyethylene; polyvinyl fluoride; polyvinylidene fluoride; polytrifluoroethylene; polyhexafluoropropylene; copolymers of vinylidene fluoride and acrylic monomers; copolymers of vinylidene fluoride and vinyl fluoride; fluoroterpolymers such as a copolymer composed of tetrafluoroethylene, vinylidene fluoride and a monomer which contains no fluoro group; and silicone resins. These may be used individually or in combination.

Specific examples of the amino resins include urea-formaldehyde resins, melamine resins, benzoguanamine resins, urea resins, polyamide resins and epoxy resins. Specific examples of the polyvinyl resins include acrylic resins, polymethyl methacrylate, polyacrylonitrile, polyvinyl acetate, polyvinyl alcohol and polyvinyl butyral. Specific examples of the polystyrene resins include polystyrene and styrene-acrylic copolymers. Specific examples of the polyhalogenated olefins include polyvinyl chloride. Specific examples of the polyester resins include polyethylene terephthalate and polybutylene terephthalate.

If necessary, the resin layer may contain conductive powder, etc. Specific examples of the conductive powder include metal powder, carbon black, titanium oxide, tin oxide and zinc oxide. The average particle diameter of the conductive powder is preferably 1 μm or less. When the average particle diameter is greater than 1 μm, it may be difficult to control electric resistance.

The resin layer can be formed by dissolving a silicone resin, etc. in a solvent so as to prepare a coating solution, then applying the coating solution over the surface of the core material by a known coating method and drying the coating solution, which is followed by firing. Examples of the coating method include immersion coating, spraying, and coating with the use of a brush. The solvent is not particularly limited and may be suitably selected according to the intended purpose. Examples thereof include toluene, xylene, methyl ethyl ketone, methyl isobutyl ketone and butyl cellosolve acetate. The firing may be based upon external heating or internal heating and may, for example, be carried out in accordance with a method using a stationary electric furnace, a fluid-type electric furnace, a rotary electric furnace, a burner furnace, etc., or a method using a microwave.

The amount of the resin layer included in the carrier is preferably in the range of 0.01% by mass to 5.0% by mass. When the amount is less than 0.01% by mass, it may be impossible to form a uniform resin layer on the surface of the core material. When the amount is greater than 5.0% by mass, a thick resin layer is formed, so that carrier particles may fuse with one another and thus the uniformity of the carrier may decrease.

The amount of the carrier included in the two-component developer is preferably in the range of 90% by mass to 98% by mass, more preferably 93% by mass to 97% by mass.

The developer may be used for image formation based upon any known electrophotographic method such as a magnetic one-component developing method, a nonmagnetic one-component developing method or a two-component developing method.

(Toner Container)

A toner container used in the present invention houses the above-mentioned toner or the above-mentioned developer therein.

The container is not particularly limited and may be suitably selected from known containers. Suitable examples thereof include a container which incorporates a developer container main body and a cap.

The size, shape, structure, material, etc. of the main body of the toner container are not particularly limited and may be suitably selected according to the intended purpose. Preferred examples of the shape thereof include cylindrical shapes. It is particularly preferred that, for example, depressions and protrusions be spirally formed on the inner circumferential surface of the main body, which allows the toner that is contained matter to move toward the side of a discharge port by means of rotation, and part or all of the spiral portion function as a bellows.

The material for the main body of the toner container is not particularly limited, and it is preferred that the material be favorable in terms of dimension accuracy. Suitable examples of the material include resins, with preference being given to polyester resins, polyethylene resins, polypropylene resins, polystyrene resins, polyvinyl chloride resins, polyacrylic acid resins, polycarbonate resins, ABS resins, polyacetal resins and the like.

The toner container in the present invention can be easily stored, conveyed, etc. and is superior in handleability, and the toner container can be suitably used to supply the toner or the developer, detachably mounted to the after-mentioned process cartridge in the present invention, an image forming apparatus, etc.

(Process Cartridge)

A process cartridge in the present invention can be installed in an image forming apparatus and includes: a latent electrostatic image bearing member configured to bear a latent electrostatic image; and a developing unit configured to develop the latent electrostatic image borne on the latent electrostatic image bearing member, using a developer, and thereby form a visible image. If necessary, the process cartridge may further include suitably selected other units such as a charging unit, an exposing unit, a developing unit, a transfer unit, a cleaning unit and a charge eliminating unit.

The developing unit includes at least a developer container which houses the above-mentioned toner or the above-mentioned developer, and a latent electrostatic image bearing member configured to bear and convey the toner or the developer housed in the developer container. Further, the developing unit may, for example, include a layer thickness regulating member to regulate the thickness of a toner layer borne.

The process cartridge in the present invention can be installed in a detachably mountable manner in any electrophotographic apparatus, any facsimile or any printer and is preferably installed in a detachably mountable manner in the after-mentioned image forming apparatus.

Figure 5:
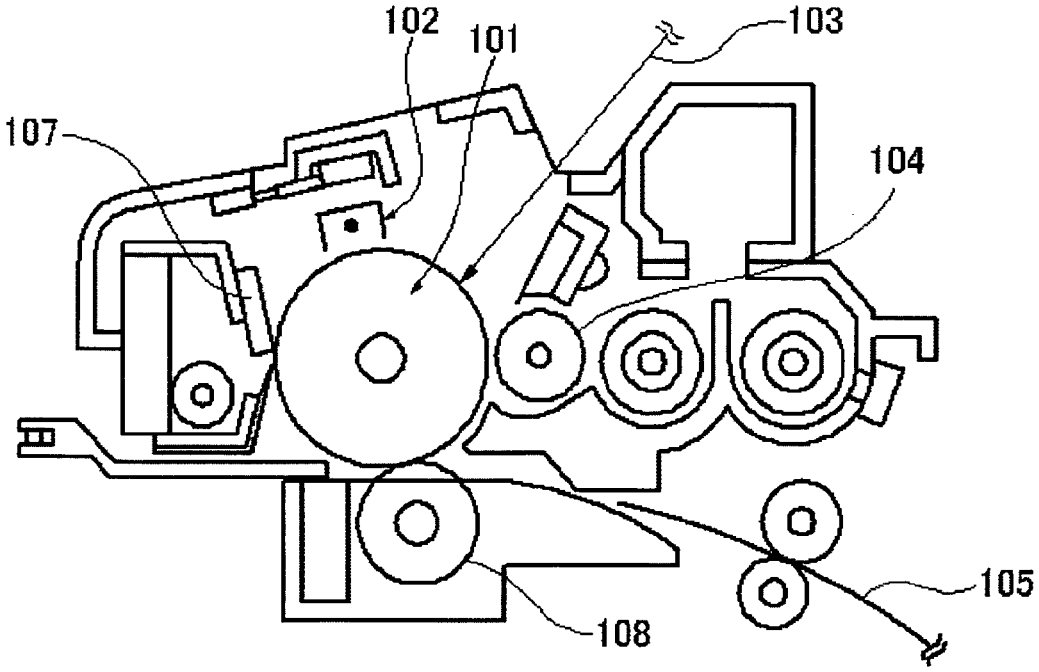
FIG. 5 is a schematic explanatory drawing showing an example of a process cartridge used in the present invention.

Here, the process cartridge includes, for example, a photoconductor 101, a charging unit 102, a developing unit 104 and a cleaning unit 107 as shown in FIG. 5. If necessary, the process cartridge may further include other members. In the example of the process cartridge shown in FIG. 5, there is provided a transfer unit 108 configured to transfer a developed toner image on the photoconductor 101 to receiver paper 105. The photoconductor 101 may be any photoconductor described above. A light source which enables writing with high resolution is used as an exposing unit 103. Any charging member may be used as the charging unit 102.

EXAMPLES

The following explains Examples of the present invention. It should, however, be noted that the scope of the present invention is not confined thereto. In Examples, the term "part(s)" and the symbol "%" are both based upon mass, and the term "mol" denotes a molar ratio.

(Production of Toner)

Example 1

—Synthesis of Unmodified Polyester (Low-Molecular Polyester)—

Into a reactor equipped with a condenser tube, a stirrer and a nitrogen-introducing tube, 229 parts of an ethylene oxide (2 mol) adduct of bisphenol A, 529 parts of a propylene oxide (3 mol) adduct of bisphenol A, 208 parts of terephthalic acid, 46 parts of adipic acid and 2 parts of dibutyltin oxide were poured. Subsequently, the ingredients were reacted together for 8 hours under normal pressure at 230° C., then the reaction liquid was further reacted for 5 hours under a reduced pressure of 10 mmHg to 15 mmHg. Thereafter, 44 parts of trimellitic anhydride was poured into the reactor, then the ingredients were reacted together for 2 hours under normal pressure at 180° C., and an unmodified polyester was thus synthesized.

The unmodified polyester had a number average molecular weight (Mn) of 2,500, a weight average molecular weight (Mw) of 6,700, a glass transition temperature (Tg) of 47° C. and an acid value of 18 mgKOH/g. The number average molecular weight, the weight average molecular weight, the glass transition temperature and the acid value were measured as follows.

[Measurement of Weight Average Molecular Weight and Number Average Molecular Weight]

The weight average molecular weight (Mw) and the number average molecular weight (Mn) of the unmodified polyester were measured using a gel permeation chromatography (GPC) measuring apparatus (GPC-8220GPC, manufactured by TOSOH CORPORATION).

Column: TSK GEL SUPER HZM-H 15 cm Three Continuous Columns (manufactured by TOSOH CORPORATION)

Temperature: 40° C.

Solvent: THF

Flow rate: 0.35 mL/min

Sample: 0.4 mL of a sample having a concentration of 0.15% was injected.

In the molecular weight measurement, the molecular weight distribution of the sample was calculated based upon the relationship between count numbers and logarithmic values of a calibration curve produced using several types of monodisperse polystyrene standard samples.

As the polystyrene standard samples for producing the calibration curve, SHOWDEX STANDARD Std. Nos. S-7300, S-210, S-390, S-875, S-1980, S-10.9, S-629, S-3.0 and S-0.580, and toluene were used. As a detector, an R1 (refractive index) detector was employed.

[Measurement of Glass Transition Temperature]

The glass transition temperature (Tg) was measured in accordance with the following procedure. As measuring apparatuses, a thermal analysis apparatus (TA-60WS, manufactured by SHIMADZU CORPORATION) and a differential scanning calorimeter (DSC-60, manufactured by SHIMADZU CORPORATION) were used, and the measurement was carried out under the following measurement conditions.

(Measurement Conditions)

Sample container: aluminum sample pan (with a lid)

Amount of sample: 5 mg

Reference: aluminum sample pan (10 mg of alumina)

Atmosphere: nitrogen (flow rate: 50 mL/min)

Temperature conditions

Initial temperature: 20° C.

Temperature increase rate: 10° C./min

End temperature: 150° C.

Time during which the temperature was held: the temperature was not held.

Temperature decrease rate: 10° C./min

End temperature: 20° C.

Time during which the temperature was held: the temperature was not held.

Temperature increase rate: 10° C./min

End temperature: 150° C.

The measurement results were analyzed using the data analysis software TA-60 ver. 1.52 (manufactured by SHIMADZU CORPORATION).

[Measurement of Acid Value]

The acid value (AV) was measured under the following conditions and based upon the method defined in JIS K0070-1992.

To 120 mL of toluene, 0.5 g of a toner as a measurement sample was added and dissolved therein with stirring at room temperature (23° C.) for 10 hours. Further, 30 mL of ethanol was added to prepare a sample solution.

Calculation for the measurement was carried out using the below apparatus. Specifically, calculation was carried out as follows: the sample solution was titrated with a previously standardized N/10 caustic potash-alcohol solution, and the acid value was determined according to the following equation, based upon the consumption of the alcohol potash solution.

$$\text{Acid value} = \text{KOH(number of milliliters)} \times N \times 56.1 / \text{Mass of sample}$$

(N denotes the factor of N/10 KOH.)

(Measuring Apparatus)

Measuring apparatus: automatic potentiometric titrator DL-53 TITRATOR (manufactured by Mettler-Toledo)

Electrode used: DG113-SC (manufactured by Mettler-Toledo)

Analysis software: LABX LIGHT Version 1.00.000

Calibration of apparatus: a mixed solvent of 120 mL of toluene and 30 mL of ethanol was used.

Measurement temperature: 23° C.

(Measuring Apparatus)

Stir

| | |
|---|---|
| Speed [%] | 25 |
| Time [s] | 15 |

EQP titration
Titrant/Sensor

| | |
|---|---|
| Titrant | $CH_3ONa$ |
| Concentration [mol/L] | 0.1 |
| Sensor | DG115 |
| Unit of measurement | mV |

Predispensing to volume

| | |
|---|---|
| Volume [mL] | 1.0 |
| Wait time [s] | 0 |

Titrant addition Dynamic

| | |
|---|---|
| dE (set) [mV] | 8.0 |
| dV (min) [mL] | 0.03 |
| dV (max) [mL] | 0.5 |

Measure mode Equilibrium controlled

| | |
|---|---|
| dE [mV] | 0.5 |
| dt [s] | 1.0 |
| t (min) [s] | 2.0 |
| t (max) [s] | 20.0 |

Recognition

| | |
|---|---|
| Threshold | 100.0 |
| Steepest jump only | No |
| Range | No |
| Tendency | None |

Termination

| | |
|---|---|
| at maximum volume [mL] | 10.0 |
| at potential | No |
| at slope | No |
| after number EQPs | Yes |
| n = 1 | |
| comb. termination conditions | No |

Evaluation

| | |
|---|---|
| Procedure | Standard |
| Potential 1 | No |
| Potential 2 | No |
| Stop for reevaluation | No |

—Preparation of Masterbatch (MB)—

Six hundred parts of water, 400 parts of carbon black (PRINTEX 35, manufactured by Degussa GmbH, DBP oil absorption=42 mL/100 g, pH=9.5) as the colorant, and 600 parts of the unmodified polyester were mixed using a Henschel mixer (manufactured by Mitsui Mining Co., Ltd.). The mixture was kneaded at 150° C. for 30 minutes using a two roll mill. Thereafter, the mixture was subjected to rolling and cooling and then pulverized using a pulverizer (manufactured by Hosokawa Micron Corporation). In this manner, a masterbatch was prepared.

—Synthesis of Wax Dispersant—

In an autoclave reactor equipped with a thermometer and a stirrer, 600 parts of xylene and 300 parts of low-molecular-weight polyethylene (SANWAX LEL-400, manufactured by Sanyo Chemical Industries, Ltd.; softening point: 128° C.) were placed, the polyethylene was sufficiently dissolved in the xylene, and nitrogen substitution was carried out. Thereafter, a mixed solution of 2,310 parts of styrene, 270 parts of acrylonitrile, 150 parts of butyl acrylate, 78 parts of di-t-butylperoxyhexahydroterephthalate and 455 parts of xylene was added dropwise at 175° C. for 3 hours so as to effect polymerization, and further, the mixture was held at this temperature for 30 minutes. Subsequently, desolvation was carried out, and a wax dispersant was thus obtained.

—Preparation of Wax Dispersion Liquid—

In a reaction container equipped with a stirring rod and a thermometer, 378 parts of the unmodified polyester, 110 parts of a wax (BE SQUARE 180 WHITE, manufactured by TOYO ADL CORPORATION; melting point: 86.4° C., decrease in mass at 165° C.: 1.7%), 33 parts of the wax dispersant and 947 parts of ethyl acetate were placed. Subsequently, the temperature was increased to 80° C. with stirring, the mixture was held for 5 hours with the temperature kept at 80° C., then cooling was carried out for 1 hour such that the temperature lowered to 30° C., and a wax dispersion liquid (1) was thus obtained.

—Preparation of Organic Solvent Phase—

A raw material solution was obtained by mixing together 2,493 parts of the wax dispersion liquid (1), 500 parts of the masterbatch and 1,012 parts of ethyl acetate for 1 hour. Then 1,324 parts of the raw material solution was moved into a reaction container. Subsequently, using a bead mill (ULTRA VISCO MILL, manufactured by AIMEX CO., Ltd.), the ingredients were passed three times under the following conditions so as to disperse the carbon black and the wax: the liquid sending rate was 1 kg/hr, the disc circumferential velocity was 6 m/sec, and zirconia beads each having a size of 0.5 mm were supplied so as to occupy 80% by volume. Thereafter, 1,324 parts of a 65% ethyl acetate solution of the unmodified polyester was added to the obtained dispersion liquid. Then, using a bead mill under conditions similar to the above conditions, the ingredients were passed once, and an organic solvent phase was thus prepared.

The solid content concentration of the organic solvent phase (measurement condition: with heating for 30 minutes at 130° C.) was 50%.

—Synthesis of Prepolymer—

In a reaction container equipped with a condenser tube, a stirrer and a nitrogen-introducing tube, 682 parts of an ethylene oxide (2 mol) adduct of bisphenol A, 81 parts of a propylene oxide (2 mol) adduct of bisphenol A, 283 parts of terephthalic acid, 22 parts of trimellitic anhydride and 2 parts of dibutyltin oxide were placed. Subsequently, the ingredients were reacted together for 7 hours under normal pressure at 230° C., then further reacted together for 5 hours under a reduced pressure of 10 mmHg to 15 mmHg, and Intermediate Polyester 1 was thus obtained. Intermediate Polyester 1 had a number average molecular weight of 2,200, a weight average molecular weight of 9,700, a peak molecular weight of 3,000, a Tg of 54° C., an acid value of 0.5 mgKOH/g and a hydroxyl value of 52 mgKOH/g.

Next, into a reaction container equipped with a condenser tube, a stirrer and a nitrogen-introducing tube, 410 parts of Intermediate Polyester 1, 89 parts of isophorone diisocyanate and 500 parts of ethyl acetate were poured, then the ingredients were reacted together at 100° C. for 5 hours, and Prepolymer 1 was thus obtained. Prepolymer 1 had a free isocyanate percent by mass of 1.53% and a solid content of 49.1%.

—Synthesis of Ketimine (Active Hydrogen Group-Containing Compound)—

In a reaction container equipped with a stirring rod and a thermometer, 170 parts of isophoronediamine and 75 parts of methyl ethyl ketone were placed, then the ingredients were reacted together at 50° C. for 5 hours, and a ketimine compound (active hydrogen group-containing compound) was thus synthesized.

The ketimine compound (active hydrogen group-containing compound) had an amine value of 418 mgKOH/g.

—Preparation of Toner Material Liquid—

In a reaction container, 749 parts of the organic solvent phase, 115 parts of Prepolymer 1, 2.9 parts of the ketimine compound and 0.4 parts of a tertiary amine compound (U-CAT660M, manufactured by Sanyo Chemical Industries, Ltd.) were placed. Subsequently, using T.K. HOMO MIXER (manufactured by Tokushu Kika Kogyo Co., Ltd.), the ingredients were mixed together at 7.5 m/s for 1 minute, and a toner material liquid was thus prepared.

—Preparation of Organic Resin Fine Particle Dispersion Liquid—

In a reaction container equipped with a stirring rod and a thermometer, 683 parts of water, 20 parts of a sodium salt of methacrylic acid ethylene oxide adduct sulfate. ("ELEMINOL RS-30", manufactured by Sanyo Chemical Industries, Ltd.), 78 parts of styrene, 78 parts of methacrylic acid, 120 parts of butyl acrylate and 1 part of ammonium persulfate were placed. Subsequently, stirring was carried out for 15 minutes at 400 revolutions per minute to thereby obtain a white emulsion. The emulsion was heated such that the system temperature reached 75° C., and the emulsion was subjected to reaction for 5 hours. Subsequently, 30 parts of a 1% ammonium persulfate aqueous solution was added, then aging was carried out at 75° C. for 5 hours, and an aqueous dispersion liquid (organic resin fine particle dispersion liquid) of vinyl resin particles (a copolymer of styrene-methacrylic acid-butyl acrylate-sodium salt of methacrylic acid ethylene oxide adduct sulfate) was thus prepared.

The volume average particle diameter (Dv) of organic resin fine particles contained in the organic resin fine particle dispersion liquid, measured using a particle size distribution measuring apparatus (NANOTRAC UPA-150EX, manufactured by NIKKISO CO., LTD.), was 55 nm. Further, part of the organic resin fine particle dispersion liquid was dried to thereby isolate a resin content, and this resin content measured 48° C. in glass transition temperature (Tg) and 450,000 in weight average molecular weight (Mw).

—Preparation of Aqueous Medium Phase—

A milky-white liquid (aqueous medium phase) was obtained by mixing and stirring 990 parts of water, 37 parts of a 48.5% aqueous solution of sodium dodecyl diphenyl ether disulfonate (ELEMINOL MON-7, manufactured by Sanyo Chemical Industries, Ltd.), 15 parts of the organic resin fine particle dispersion liquid and 90 parts of ethyl acetate.

<Toner Granulating Step>

—Emulsion or Dispersion—

Into the toner material liquid, 1,200 parts of the aqueous medium phase was added, then the ingredients were mixed together at a circumferential velocity of 15 m/s for 20 minutes using T.K. HOMO MIXER (manufactured by Tokushu Kika Kogyo Co., Ltd.), and an oil-in-water dispersion liquid (emulsified slurry) was thus prepared.

—Removal of Organic Solvent—

In a reaction container equipped with a stirring rod and a thermometer, the emulsified slurry which had been controlled in terms of particle diameter was placed, then desolvation was carried out under reduced pressure at 30° C. for 8 hours. When the amount of residual ethyl acetate became 5%, the pressure was changed back to normal pressure, and heating was carried out at 45° C. for 2 hours in a hermetically-closed state. Thereafter, cooling was carried out, the desolvation was continued, and a dispersion slurry was thus obtained.

—Washing and Drying—

One hundred parts of the dispersion slurry was filtered under reduced pressure, then 100 parts of ion-exchange water was added to the obtained filter cake, which was followed by mixing using T.K. HOMO MIXER (at a rotational speed of 10.0 m/s for 10 minutes), and subsequently the mixture was filtered. One hundred parts of ion-exchange water was added to the obtained filter cake, which was followed by mixing using T.K. HOMO MIXER (at a rotational speed of 10.0 m/s for 10 minutes). The pH of the mixture at that time was 6.3. Thereafter, filtration under reduced pressure was carried out. One hundred parts of a 10% sodium hydroxide aqueous solution was added to the obtained filter cake, which was followed by mixing using T.K. HOMO MIXER (at a rotational speed of 10.0 m/s for 10 minutes), and subsequently the mixture was filtered. Three hundred parts of ion-exchange water was added to the obtained filter cake, which was followed by mixing using T.K. HOMO MIXER (at a rotational speed of 10.0 m/s for 10 minutes), and subsequently the mixture was filtered twice. On that occasion, the aqueous dispersion had a pH of 6.2 with the first filtration, and a pH of 6.4 with the second filtration. Three hundred parts of ion-exchange water was added to the obtained filter cake, which was followed by mixing using T.K. HOMO MIXER (at a rotational speed of 10.0 m/s for 10 minutes); subsequently, the pH of the mixture was adjusted to 4 using a 10% hydrochloric acid solution, then the mixture was stirred for 1 hour and filtered. Three hundred parts of ion-exchange water was added to the obtained filter cake, which was followed by mixing using T.K. HOMO MIXER (at a rotational speed of 10.0 m/s for 10 minutes), then the mixture was filtered twice, and a final filter cake was thus obtained. The final filter cake was dried at 45° C. for 48 hours using a wind circulation dryer and then sieved using a mesh with a sieve mesh size of 75 μm, and toner base particles of Example 1 were thus obtained.

—Treatment with External Additive—

Using a Henschel mixer (manufactured by Mitsui Mining Co., Ltd.), 1.5 parts of hydrophobic silica and 0.5 parts of hydrophobized titanium oxide, which served as external additives, were mixed with 100 parts of the toner base particles of Example 1, then the mixture was sifted using a mesh with a sieve mesh size of 35 μm, and a toner of Example 1 was thus produced.

<Measurement of Peak Intensity Ratio and Storage Elastic Modulus>

Regarding this toner, the value of the peak intensity ratio representing the wax composition, measured by FTIR-ATR (SPECTRUM ONE MULTISCOPE, manufactured by PerkinElmer Inc.) at 23° C., was 0.15.

The toner was placed in a heating apparatus (MOISTURE DETERMINATION BALANCE FD600) and then heated to 140° C. Immediately after heated to 140° C., the toner was cooled to 40° C. by means of airflow. Then the peak intensity ratio representing the wax composition was measured four times by FTIR-ATR (SPECTRUM ONE MULTISCOPE, manufactured by PerkinElmer Inc.), and the average was 0.45. The storage elastic modulus of the toner, measured using a storage elastic modulus measuring apparatus (RHEOSTRESS RS50, manufactured by Haake GmbH), was 5,500 Pa.

<Average Particle Diameter of Toner>

The volume average particle diameter (Dv) and the number average particle diameter (Dn) of the toner, and Dv/Dn were measured using a particle size measuring apparatus (MULTISIZER III, manufactured by Beckman Coulter, Inc.) with an aperture diameter of 100 μm and analyzed using analysis software (BECKMAN COULTER MULTISIZER 3 Version 3.51). Specifically, into a 100 mL glass beaker, 0.5 mL of a 10% surfactant (alkylbenzene sulfonate, NEOGEN SC-A, manufactured by DAI-ICHI KOGYO SEIYAKU CO., LTD.) was poured, 0.5 g of the toner was poured, then these were stirred using a micro spatula. Subsequently, 80 mL of ion-exchange water was added. The obtained dispersion liquid was subjected to dispersion treatment for 10 minutes using an ultrasonic dispersing apparatus (W-113MK-II, manufactured by Honda Electronics Co., Ltd.). Measurement was carried out on the dispersion liquid using MULTISIZER III, also using ISOTON-III (manufactured by Beckman Coulter, Inc.) as a measurement solution. In the measurement, the dispersion liquid as a toner sample was added dropwise such that the concentration shown by the apparatus became 8%±2%. In this measuring process, the adjustment of the concentration to 8%±2% is important in view of reproducibility of the particle diameter measurement. Provided that the concentration is kept in this range, there is no error in particle diameter.

<Evaluation of Fixation Properties of Toner>

Fixation properties of the toner were evaluated as follows. The evaluations were carried out using IMAGIO NEO C600 (manufactured by Ricoh Company, Ltd.) incorporating the belt-type heat fixing device shown in FIG. 1. The base material of the belt was made of a polyimide (100 μm in thickness), the elastic layer was made of silicone rubber (100 μm in thickness), the release layer at the surface was made of PFA (15 μm in thickness), the fixing roller was made of silicone foam, the pressurizing roller had a metal cylinder made of SUS (1 mm in thickness), the pressuring roller also had an offset preventing layer composed of a PFA tube and silicone rubber (2 mm in thickness), the heating roller was made of aluminum (2 mm in thickness), and the surface pressure was $1\times10^5$ Pa.

[Evaluation Criteria]

—Low-Temperature Fixability—

A: Lower than 120° C.

B: 120° C. or higher, but lower than 130° C.

C: 130° C. or higher, but lower than 140° C.

D: 140° C. or higher, but lower than 150° C.

E: 150° C. or higher

[Evaluation Criteria]

—Hot Offset Resistance—

A: 200° C. or higher

B: Lower than 200° C., but 190° C. or higher

C: Lower than 190° C., but 180° C. or higher

D: Lower than 180° C., but 170° C. or higher

E: Lower than 170° C.

<Separability>

Figure 4:
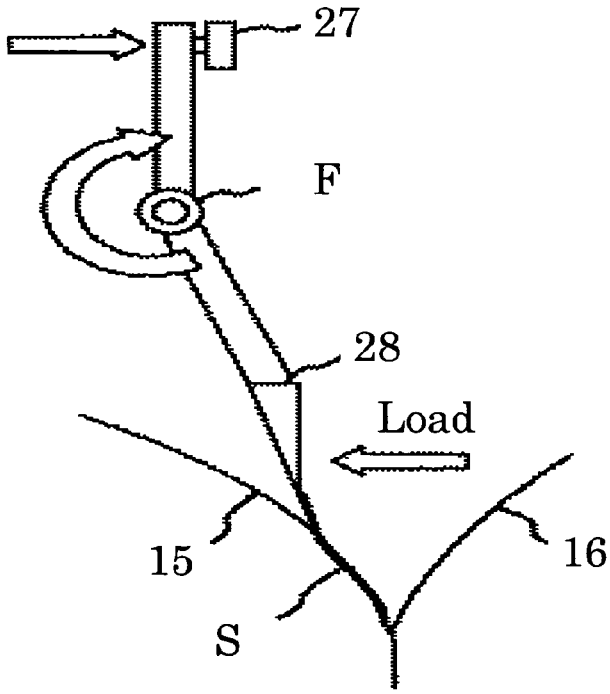
FIG. 4 is a schematic explanatory drawing showing an example of a measuring device for measuring the pushing force of a recording medium.

The separability was evaluated using a measuring device for measuring the pushing force of a recording medium, as shown in FIG. 4. In FIG. 4, a recording medium S is conveyed in such a manner as to be pushed against one end of a measuring claw 28. The value of the pushing force at that time was read by a load cell 27 provided at the other end of the measuring claw 28. As shown in FIG. 4, the measuring claw 28 was provided immediately behind a fixing nip portion 16, on the side of a fixing roller 15. Also in FIG. 4, the letter F denotes a fulcrum.

The value of the pushing force read by the load cell 27 is the force required to separate the recording medium S from the fixing roller 15, and this force is defined as the separation resistance force. Whether or not separation of the recording medium S from the fixing roller 15 was possible was judged based upon the extent of the separation resistance force measured under these predetermined conditions. In this evaluation, the separation resistance force at a fixation temperature of 160° C. was defined as the separation resistance force of the toner. The amount of the toner attached at the time of the measurement was 0.9 g/cm$^2$.

[Evaluation Criteria]

—Separability—

A: 50 gf or less

B: Greater than 50 gf, but 200 gf or less

C: Greater than 200 gf, but 400 gf or less

D: Greater than 400 gf

<Filming Resistance>

Whether or not toner filming had occurred on a developing roller or a photoconductor, when copying had been carried out on 50,000 sheets using a color electrophotographic apparatus (IPSIO COLOR 8100, manufactured by Ricoh Company, Ltd.), was visually observed and the filming resistance was evaluated in accordance with the following criteria.

[Evaluation Criteria]

—Filming Resistance—

A: Filming was not observed.

B: Filming in the form of streaks was hardly observed.

C: Filming in the form of streaks was partially observed.

D: Filming was observed in every part.

<Blocking Resistance>

The amount of the toner was measured and adjusted to 10 g, then the toner was placed in a 20 mL glass container, and the glass container was tapped 100 times. Thereafter, the toner placed in the glass container was left to stand for 24 hours in a constant temperature bath set at a temperature of 55° C. and a humidity of 80%, then the penetration of the toner was measured using a penetrometer.

[Evaluation Criteria]

—Blocking Resistance—

A: 20 mm or greater

B: 15 mm or greater, but less than 20 mm

C: 10 mm or greater, but less than 15 mm

D: Less than 10 mm

Example 2

A toner was produced in the same manner as in Example 1, except that the amount of the wax dispersant was changed from 33 parts to 66 parts in the preparation of the wax dispersion liquid. Tests and evaluations were carried out in the same manner as in Example 1.

Example 3

A toner was produced in the same manner as in Example 1, except that the amount of the wax dispersant was changed from 33 parts to 88 parts in the preparation of the wax dispersion liquid. Tests and evaluations were carried out in the same manner as in Example 1.

Example 4

A toner was produced in the same manner as in Example 1, except that the amount of the wax dispersant was changed from 33 parts to 88 parts in the preparation of the wax dispersion liquid, and that the heating was carried out at 45° C. for 6 hours instead of being carried out at 45° C. for 2 hours in the removal of the organic solvent. Tests and evaluations were carried out in the same manner as in Example 1.

Example 5

A toner was produced in the same manner as in Example 1, except that the amount of the wax dispersant was changed from 33 parts to 88 parts in the preparation of the wax dispersion liquid, and that the heating was carried out at 50° C. for 6 hours instead of being carried out at 45° C. for 2 hours in the removal of the organic solvent. Tests and evaluations were carried out in the same manner as in Example 1.

Example 6

A toner was produced in the same manner as in Example 1, except that the amount of the wax dispersant was changed from 33 parts to 22 parts in the preparation of the wax dispersion liquid. Tests and evaluations were carried out in the same manner as in Example 1.

Comparative Example 1

A toner was produced in the same manner as in Example 1, except that the amount of the wax dispersant was changed from 33 parts to 0 parts in the preparation of the wax dispersion liquid. Tests and evaluations were carried out in the same manner as in Example 1.

Comparative Example 2

A toner was produced in the same manner as in Example 1, except that the heating at 45° C. for 2 hours was not carried out in the removal of the organic solvent. Tests and evaluations were carried out in the same manner as in Example 1.

The acid values, the glass transition temperatures (Tg), etc. of the binder resins, the types of the waxes, and so forth regarding Examples 1 to 6 and Comparative Examples 1 and 2 are together shown in Table 2.

TABLE 1

| | | | 140° C. | | | | | | | |
|---|---|---|---|---|---|---|---|---|---|---|
| | Dv | Dv/Dn | ATR | Storage elastic modulus | 23° C. ATR | Low-temperature fixability | Hot offset resistance | Separability | Filming resistance | Blocking resistance |
| Ex. 1 | 4.7 | 1.12 | 0.45 | 5,500 | 0.15 | A | A | A | B | B |
| Ex. 2 | 5.1 | 1.09 | 0.25 | 5,300 | 0.08 | A | B | B | B | A |
| Ex. 3 | 4.8 | 1.11 | 0.13 | 5,700 | 0.05 | A | B | B | A | A |
| Ex. 4 | 5.2 | 1.09 | 0.14 | 8,000 | 0.05 | B | B | A | A | A |
| Ex. 5 | 4.4 | 1.10 | 0.12 | 9,500 | 0.05 | B | A | A | A | A |
| Ex. 6 | 4.7 | 1.13 | 0.48 | 5,600 | 0.18 | A | A | A | C | C |
| Comp. Ex. 1 | 5.3 | 1.18 | 0.55 | 5,200 | 0.25 | A | A | A | D | D |
| Comp. Ex. 2 | 5.1 | 1.12 | 0.25 | 4,500 | 0.15 | A | C | D | B | C |

In Table 1,

Dv denotes the volume average particle diameter (μm) of the toner,

Dv/Dn denotes "volume average particle diameter/number average particle diameter", and the unit of the storage elastic modulus is "Pa".

TABLE 2

| | | Ex. 1 | Ex. 2 | Ex. 3 | Ex. 4 | Ex. 5 | Ex. 6 | Comp. Ex. 1 | Comp. Ex. 2 |
|---|---|---|---|---|---|---|---|---|---|
| Binder resin | Acid Value | 18 | 18 | 18 | 18 | 18 | 18 | 18 | 18 |
| | Tg (° C.) | 47 | 47 | 47 | 47 | 47 | 47 | 47 | 47 |
| | Number average molecular weight | 2,500 | 2,500 | 2,500 | 2,500 | 2,500 | 2,500 | 2,500 | 2,500 |
| | Weight average molecular weight | 6,700 | 6,700 | 6,700 | 6,700 | 6,700 | 6,700 | 6,700 | 6,700 |
| | Amount | 110 | 110 | 110 | 110 | 110 | 110 | 110 | 110 |
| Wax | Melting point (° C.) | 86.4 | 86.4 | 86.4 | 86.4 | 86.4 | 86.4 | 86.4 | 86.4 |
| | Amount | 110 | 110 | 110 | 110 | 110 | 110 | 110 | 110 |
| Wax dispersant | Amount | 33 | 66 | 88 | 88 | 88 | 22 | 0 | 33 |

In Table 2, the unit of the acid value is "mgKOH/g", and the unit of the amounts of the binder resin, the wax and the wax dispersant is "parts by mass".

As can be understood from Table 1, Examples 1 to 6 yielded favorable results in terms of low-temperature fixability, hot offset resistance, separability and filming resistance. Meanwhile, it can be understood that Comparative Examples 1 and 2 were inferior to Examples 1 to 6 except for low-temperature fixability. That is, it can be understood that favorable results regarding low-temperature fixability, hot offset resistance, separability and filming resistance are yielded by adjusting the intensity ratio of an absorbance derived from the wax to an absorbance derived from the binder resin to the range of 0.1 to 0.5 (where the absorbances are measured by FTIR-ATR and the intensity ratio serves as a value for determining the amount of the wax present within 0.3 μm in depth from surfaces of particles of the toner after the toner has been heated to 140° C. and then cooled) and by adjusting the storage elastic modulus of the toner to 5,000 Pa or greater at 140° C.

| Reference Signs List | |
|---|---|
| Z | fixing device |
| R1 | fixing roller |
| R2 | pressurizing roller |
| R3 | heating roller |
| R4 | cleaning roller |
| B | fixing belt |
| P | pressurizing spring |
| G | guide |
| H | heat source |
| C | fixing belt |
| 1 | base material |
| 2 | heat generating layer |
| 3 | elastic layer |
| 4 | release layer |
| 15 | fixing roller |
| 16 | fixing nip portion |
| 27 | load cell |
| 28 | measuring claw |
| F | fulcrum |
| S | recording medium |
| 101 | photoconductor |
| 102 | charging unit |
| 103 | exposing unit |
| 104 | developing unit |
| 105 | receiver paper |
| 107 | cleaning unit |
| 108 | transfer unit |

The invention claimed is:

1. An electrostatic image developing toner comprising:
a binder resin;
a colorant;
a wax,
and a wax dispersant in an amount of 10 parts by mass to 300 parts by mass per 100 parts by mass of the wax;
wherein an intensity ratio of an absorbance of the wax at 2,850 $cm^{-1}$ to an absorbance of the binder resin at 828 $cm^{-1}$ is in a range of 0.1 to 0.5,
where the absorbances are measured by FTIR-ATR, and the intensity ratio indicates an amount of the wax present within 0.3 μm in depth from surfaces of particles of the toner after the toner has been heated to 140° C. and then cooled, and
wherein the toner has a storage elastic modulus of 5,000 Pa or greater at 140° C.

2. The toner of claim 1, wherein the wax has a melting point of 65° C. to 95° C. and decreases in mass by 10% or less at 165° C.

3. The toner of claim 1, wherein the wax is at least one selected from the group consisting of a microcrystalline wax, a paraffin wax, a polyethylene wax and a polypropylene wax.

4. The toner of claim 1, wherein the binder resin comprises a reaction product obtained by reacting a compound comprising an active hydrogen group with a polymer.

5. The toner of claim 1, wherein the binder resin comprises a binder resin precursor.

6. The toner of claim 5, wherein the binder resin precursor is a reaction product obtained by reacting a compound comprising an active hydrogen group with a polymer, and emulsifying or dispersing the compound and the polymer in an aqueous medium.

7. The toner of claim 6, wherein the polymer has a weight average molecular weight of 3,000 to 45,000.

8. The toner of claim 1, wherein the binder resin comprises a polyester resin.

9. The toner of claim 1, wherein the binder resin has a weight average molecular weight of 3,000 to 30,000.

10. The toner of claim 1, wherein the binder resin has an acid value of 12 mgKOH/g to 30 mgKOH/g.

11. The toner of claim 1, wherein the binder resin has a glass transition temperature of 35° C. to 65° C.

12. The toner of claim 1, wherein a ratio of a volume average particle diameter of the toner particles to a number average particle diameter of the toner particles is in a range of 1.00 to 1.25.

13. The toner of claim 1, wherein a second intensity ratio of an absorbance of the wax at 2,850 $cm^{-1}$ to an absorbance of the binder resin at 828 $cm^{-1}$ is in a range of 0.01 to 0.150,
where the absorbances are measured by FTIR-ATR, and the second intensity ratio indicates an amount of the wax present within 0.3 μm in depth from the surfaces of the particles of the toner at 23° C.

14. The toner of claim 13, wherein the toner is obtained by a process comprising
dissolving or dispersing the binder resin, the colorant and the wax in an organic solvent to obtain a solution or a dispersion liquid,
dispersing the solution or the dispersion liquid in an aqueous solvent, and
subsequently removing the organic solvent,
wherein, in the removal of the organic solvent, heating is performed for 60 minutes or longer at 30° C. to 65° C. when an amount of residual organic solvent is in a range of 2% by mass to 15% by mass.

15. The toner of claim 1, having a storage elastic modulus of 6,000 Pa or greater at 140° C.

16. The toner of claim 1, wherein the binder resin has a hydroxyl value of 25 mgKOH/g or greater.

17. The toner of claim 1, wherein the binder resin has a hydroxyl value of 35 mgKOH/g to 58 mgKOH/g.

18. The toner of claim 1, wherein the binder resin has a glass transition temperature of 45° C. to 65° C.

19. The toner of claim 1, wherein the intensity ratio is 0.1 to 0.3.

20. The toner of claim 1, wherein the toner is obtained by a process comprising
dissolving or dispersing the binder resin, the colorant and the wax in an organic solvent to obtain a solution or a dispersion liquid,
dispersing the solution or the dispersion liquid in an aqueous solvent, and
subsequently removing the organic solvent,
wherein, in the removal of the organic solvent, heating is performed for 60 minutes or longer at 30° C. to 65° C. when an amount of residual organic solvent is in a range of 2% by mass to 15% by mass.

* * * * *